US011837176B2

(12) United States Patent
Park et al.

(10) Patent No.: US 11,837,176 B2
(45) Date of Patent: Dec. 5, 2023

(54) DISPLAY DEVICE, TIMING CONTROLLER AND DISPLAY PANEL

(71) Applicant: LG DISPLAY CO., LTD., Seoul (KR)

(72) Inventors: SangHyun Park, Seoul (KR); MookYoung Hong, Gyeonggi-do (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/883,275

(22) Filed: Aug. 8, 2022

(65) Prior Publication Data

US 2023/0066738 A1 Mar. 2, 2023

(30) Foreign Application Priority Data

Sep. 2, 2021 (KR) ..... 10-2021-0116724

(51) Int. Cl.
*G09G 3/3275* (2016.01)
*G09G 3/3266* (2016.01)

(52) U.S. Cl.
CPC ..... *G09G 3/3275* (2013.01); *G09G 3/3266* (2013.01); *G09G 2310/027* (2013.01); *G09G 2310/0278* (2013.01); *G09G 2310/061* (2013.01); *G09G 2310/08* (2013.01)

(58) Field of Classification Search
None
See application file for complete search history.

(56) References Cited

U.S. PATENT DOCUMENTS

2016/0189617 A1* 6/2016 Park ..... G09G 5/10 345/690
2018/0061295 A1* 3/2018 Hong ..... G09G 3/3283
2022/0262295 A1* 8/2022 Kim ..... G09G 3/3233
2022/0358885 A1* 11/2022 Lee ..... G09G 3/3233

* cited by examiner

*Primary Examiner* — Chineyere D Wills-Burns
*Assistant Examiner* — Amen W Bogale
(74) *Attorney, Agent, or Firm* — Birch, Stewart, Kolasch & Birch, LLP

(57) ABSTRACT

A display device can include a display panel including a plurality of subpixels configured to display an image; a data driving circuit configured to supply a data signal to the plurality of subpixels; a gate driving circuit configured to supply a gate signal to the plurality of subpixels; and a timing controller configured to receive image data of a subsequent frame of an image of a current frame being displayed on the display panel, and differently control the data driving circuit during a blank period between the current frame and the subsequent frame based on a gray value of at least one edge subpixel among a plurality of edge subpixels in the image data of the subsequent frame. the plurality of edge subpixels are subpixels among the plurality of subpixels that are located adjacent to the gate driving circuit or at an edge of the display panel.

19 Claims, 16 Drawing Sheets

DISPLAY DEVICE, TIMING CONTROLLER AND DISPLAY PANEL

CROSS REFERENCE TO RELATED APPLICATION

This application claims priority to Korean Patent Application No. 10-2021-0116724, filed in the Republic of Korea on Sep. 2, 2021, the entirety of which is hereby incorporated by reference for all purposes as if fully set forth herein.

BACKGROUND OF THE DISCLOSURE

Field

Embodiments relate to a display device, a timing controller and a display panel.

Description of Related Art

In response to the development of the information society, demand for various types of image display devices is increasing. In this regard, a range of display devices, such as a liquid crystal display (LCD) and an organic light-emitting diode (OLED) display, have recently come into widespread use.

A display device displays images by driving a plurality of subpixels. As images are displayed for an extended amount of time, characteristic values of the plurality of subpixels may change. The display device can sense the characteristic values of the plurality of subpixels in real time and compensate for changes in the characteristic values of the plurality of subpixels in real time. However, when sensing is performed during certain times, such as during dark scenes or on subpixels located in a dark portion of an image, subpixels located near an edge of the display may undesirably appear brighter or more prominent to a user.

SUMMARY OF THE DISCLOSURE

Embodiments of the present disclosure may provide a display device and a timing controller for selecting a real-time sensing subpixel based on image data of a subsequent frame.

Also provided are a display device and a timing controller able to reduce a phenomenon in which a real-time sensing line is visually recognized by a user.

Embodiments provide a display device including: a display panel including a plurality of subpixels displaying an image of a corresponding frame; a data driving circuit configured to supply a data signal to the plurality of subpixels; a gate driving circuit configured to supply a gate signal to the plurality of subpixels; and a timing controller configured to receive image data of a subsequent frame of an image being displayed on the display panel and differently control the data driving circuit during a blank period between a period in which the image of the corresponding frame is displayed and a period in which an image of the subsequent frame is displayed, depending on gray values of a plurality of edge subpixels adjacent to the gate driving circuit in the image data of the subsequent frame.

Embodiments provide a timing controller configured to control a driving circuit to drive a display panel by receiving image data of a subsequent frame of an image being displayed on the display panel. The timing controller may include: an image data storage configured to store, from the image data, values matching positions of a plurality of subpixels and gray values according to the positions of the plurality of subpixels; an edge subpixel information calculator configured to, by referring to the values stored in the image data storage, compare gray values of edge subpixels positioned in an edge area of the display panel with a predetermined gray value and calculate comparison result values according to results of the comparison; and a real-time sensing determiner configured to determine whether or not to perform a real-time sensing process by referring to the comparison result values calculated by the edge subpixel information calculator.

Embodiments provide a display panel including: a display panel including a plurality of subpixels; a data driving circuit supplying a data signal to the plurality of subpixels; and a timing controller controlling the data driving circuit by receiving image data having two gray values during a plurality of frame periods. The plurality of subpixels may include edge subpixels positioned adjacent to the gate driving circuit. The edge subpixels may include first edge subpixels displaying a high gray image of the two gray values during the plurality of frame periods. The data driving circuit may apply the data signal having a first voltage level to one edge subpixel among the first edge subpixels or one subpixel, among the plurality of subpixels, to which a gate signal the same as a gate signal input to the one edge subpixel is input, in a blank period, and after a period in which the data signal having the first voltage level is applied to the subpixel, apply the data signal having a second voltage level lower than the first voltage level to subpixels, from among the plurality of subpixels, positioned in the same row as the subpixel to which the data signal having the first voltage level is applied.

According to embodiments, the display device and the timing controller can select a real-time sensing subpixel based on image data of a subsequent frame.

According to embodiments, the display device and the timing controller can reduce a phenomenon in which a real-time sensing line is visually recognized by a user.

BRIEF DESCRIPTION OF THE DRAWINGS

The above and other objectives, features, and advantages of the present disclosure will be more clearly understood from the following detailed description, taken in conjunction with the accompanying drawings, in which.

DETAILED DESCRIPTION OF THE EMBODIMENTS

Figure 1:
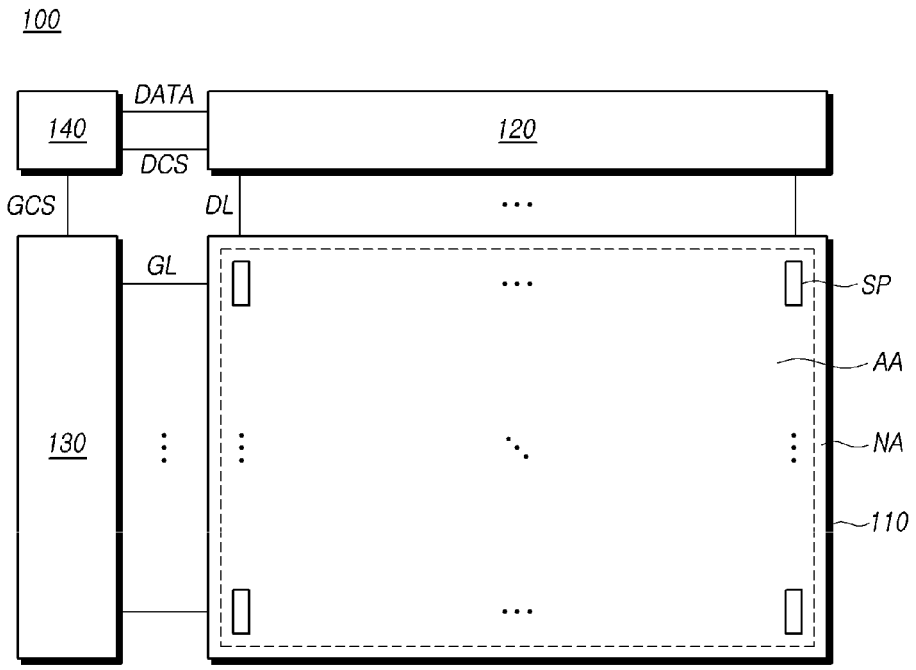
FIG. 1 illustrates a display device according to embodiments of the present disclosure.

In the following description of examples or embodiments of the present invention, reference will be made to the accompanying drawings in which it is shown by way of illustration specific examples or embodiments that can be implemented, and in which the same reference numerals and signs can be used to designate the same or like components even when they are shown in different accompanying drawings from one another. Further, in the following description of examples or embodiments of the present invention, detailed descriptions of well-known functions and components incorporated herein will be omitted when it is determined that the description may make the subject matter in some embodiments of the present invention rather unclear. The terms such as "including," "having," "containing," "constituting" "made up of," and "formed of" used herein are generally intended to allow other components to be added unless the terms are used with the term "only." As used herein, singular forms are intended to include plural forms unless the context clearly indicates otherwise.

Terms, such as "first," "second," "A," "B," "(A)," or "(B)" may be used herein to describe elements of the present invention. Each of these terms is not used to define essence, order, sequence, or number of elements etc., but is used merely to distinguish the corresponding element from other elements.

When it is mentioned that a first element "is connected or coupled to," "contacts or overlaps" etc. a second element, it should be interpreted that, not only can the first element "be directly connected or coupled to" or "directly contact or overlap" the second element, but a third element can also be "interposed" between the first and second elements, or the first and second elements can "be connected or coupled to," "contact or overlap," etc. each other via a fourth element. Here, the second element may be included in at least one of two or more elements that "are connected or coupled to," "contact or overlap," etc. each other.

When time relative terms, such as "after," "subsequent to," "next," "before," and the like, are used to describe processes or operations of elements or configurations, or flows or steps in operating, processing, manufacturing methods, these terms may be used to describe non-consecutive or non-sequential processes or operations unless the term "directly" or "immediately" is used together.

In addition, when any dimensions, relative sizes etc. are mentioned, it should be considered that numerical values for an elements or features, or corresponding information (e.g., level, range, etc.) include a tolerance or error range that may be caused by various factors (e.g., process factors, internal or external impact, noise, etc.) even when a relevant description is not specified. Further, the term "may" fully encompasses all the meanings of the term "can."

Hereinafter, a variety of embodiments will be described with reference to the accompanying drawings.

FIG. 1 illustrates a display device 100 according to embodiments.

Referring to FIG. 1, the display device 100 according to embodiments can include a display panel 110, a data driving circuit 120 and a gate driving circuit 130 driving the display panel 110, and a controller 140 controlling the data driving circuit 120 and the gate driving circuit 130.

In the display panel 110, a plurality of signal lines, such as a plurality of data lines DL and a plurality of gate lines GL, can be disposed on a substrate. A plurality of subpixels SP to which the plurality of data lines DL and the plurality of gate lines GL are connected can also be disposed in the display panel 110.

The display panel 110 can include an active area AA on which images are displayed and a non-active area NA on which images are not displayed. In the display panel 110, the plurality of subpixels SP for displaying images are disposed in the active area AA. In the non-active area NA, a pad part on which the data driving circuit 120 and the gate driving circuit 130 are mounted or to which the data driving circuit 120 or the gate driving circuit 130 is connected can be disposed.

The data driving circuit 120 is a circuit configured to drive the plurality of data lines DL, and can provide data signals to the plurality of data lines DL. The gate driving circuit 130 is a circuit configured to drive the plurality of gate lines GL, and can provide gate signals Vgate to the plurality of gate lines GL. The controller 140 can provide data driving timing control signals DCS to the data driving circuit 120 to control the operation timing of the data driving circuit 120. The controller 140 can provide gate driving timing control signals GCS to the gate driving circuit 130 to control the operation timing of the gate driving circuit 130.

The controller 140 can start scanning at points in time defined for respective frames, convert image data input from an external source into image data DATA having a data signal format readable by the data driving circuit 120, provide the image data DATA to the data driving circuit 120, and control data driving at appropriate points in time in response to the scanning.

The controller 140 receives a variety of timing signals, such as a vertical synchronization signal Vsync, a horizontal synchronization signal Hsync, a data enable (DE) signal, and a clock (CLK) signal, as well as the input image data, from an external source (e.g., a host system).

The controller 140 receives timing signals, such as a vertical synchronization signal Vsync, a horizontal synchronization signal Hsync, a data enable (DE) signal, and a clock (CLK) signal, generates a variety of control signals DCS and GCS, and outputs the variety of control signals DCS and GCS to the data driving circuit 120 and the gate driving circuit 130, in order to control the data driving circuit 120 and the gate driving circuit 130.

The controller 140 outputs a variety of gate driving timing control signals GCS including a gate start pulse (GSP), a gate shift clock (GSC), a gate output enable (GOE) signal, and the like in order to control the gate driving circuit 130.

The controller 140 outputs a variety of data driving timing control signals DCS including a source start pulse (SSP), a source sampling clock (SSC), and the like in order to control the data driving circuit 120.

The data driving circuit 120 drives the plurality of data lines DL by receiving the image data DATA from the controller 140.

The data driving circuit 120 can include one or more source driving integrated circuits (SDICs).

Each of the SDICs can be connected to the display panel 110 by a tape-automated bonding (TAB) method, connected to a bonding pad of the display panel 110 by a chip-on-glass (COG) method, or implemented as a chip-on-film (COF) structure connected to the display panel 110.

The gate driving circuit 130 can output gate signals having a turn-on level or a turn-off level, under the control of the controller 140. The gate driving circuit 130 can drive the plurality of gate lines GL by providing gate signals having a turn-on level or a turn-off level to the plurality of gate lines GL.

The gate driving circuit 130 can be connected to the display panel 110 by a TAB method, connected to a bonding pad of the display panel 110 by a COG method or a COP method, or connected to the display panel 110 by a COF method.

Alternatively, the gate driving circuit 130 can be formed in the non-active area NA of the display panel 110 by a gate-in-panel (GIP) method. The gate driving circuit 130 can be disposed on the substrate of the display panel 110 or connected to the substrate of the display panel 110. When the gate driving circuit 130 is a GIP type, the gate driving circuit 130 can be disposed in the non-active area NA of the substrate. When the gate driving circuit 130 is a COG type or a COF type, the gate driving circuit 130 can be connected to the substrate of the display panel 110.

When a specific gate line GL among the plurality of gate lines GL is opened by the gate driving circuit 130, the data driving circuit 120 can convert the image data DATA received from the controller 140 into analog data signals and supply the analog data signals to the plurality of data lines DL.

The data driving circuit 120 can be connected to one side (e.g., a top side or a bottom side) of the display panel 110. The data driving circuit 120 can be connected to both sides (e.g., both the top side and the bottom side) of the display panel 110 or connected to two or more sides among four sides of the of the display panel 110, depending on the driving method, the design of the display panel, or the like.

The gate driving circuit 130 can be connected to one side (e.g., a left side or a right side) of the display panel 110. The gate driving circuit 130 can be connected to both sides (e.g., both the left side and the right side) of the display panel 110 or connected to two or more sides among four sides of the of the display panel 110, depending on the driving method, the design of the display panel, or the like.

The controller 140 can be a timing controller, can be a control device including a timing controller and able to perform other control functions, can be a control device different from the timing controller, or can be a circuit in a control device. The controller 140 can be implemented as a variety of circuits or electronic components, such as an integrated circuit (IC), a field programmable gate array (FPGA), an application specific integrated circuit (ASIC), a processor, or the like.

The controller 140 can be mounted on a printed circuit board (PCB), a flexible printed circuit (FPC), or the like and electrically connected to the data driving circuit 120 and the gate driving circuit 130 through the PCB, the FPC, or the like.

The controller 140 can transmit or receive signals to or from the data driving circuit 120 through one or more predetermined interfaces. The interface can include, for example, a low voltage differential signaling (LVDS) interface, an embedded point-to-point interface (EPI), a serial peripheral interface (SPI), and the like.

The controller 140 can include a storage medium, such as one or more registers.

The display device 100 according to the present embodiments can be a display, such as a liquid crystal display device, including a backlight unit, or can be a self-emissive display, such as an organic light-emitting diode (OLED) display, a quantum dot display, or a micro light-emitting diode (LED) display.

When the display device 100 according to the present embodiments is an organic light-emitting diode display, each of the subpixels SP can include an organic light-emitting diode OLED as an emitting element. When the display device 100 is a quantum dot display, each of the subpixels SP can include an emitting element implemented as a quantum dot that is a self-emissive semiconductor crystal. When the display device 100 according to the present embodiments is a micro LED display, each of the subpixels SP can include a self-emissive micro LED based on an inorganic material as an emitting element.

Figure 2:
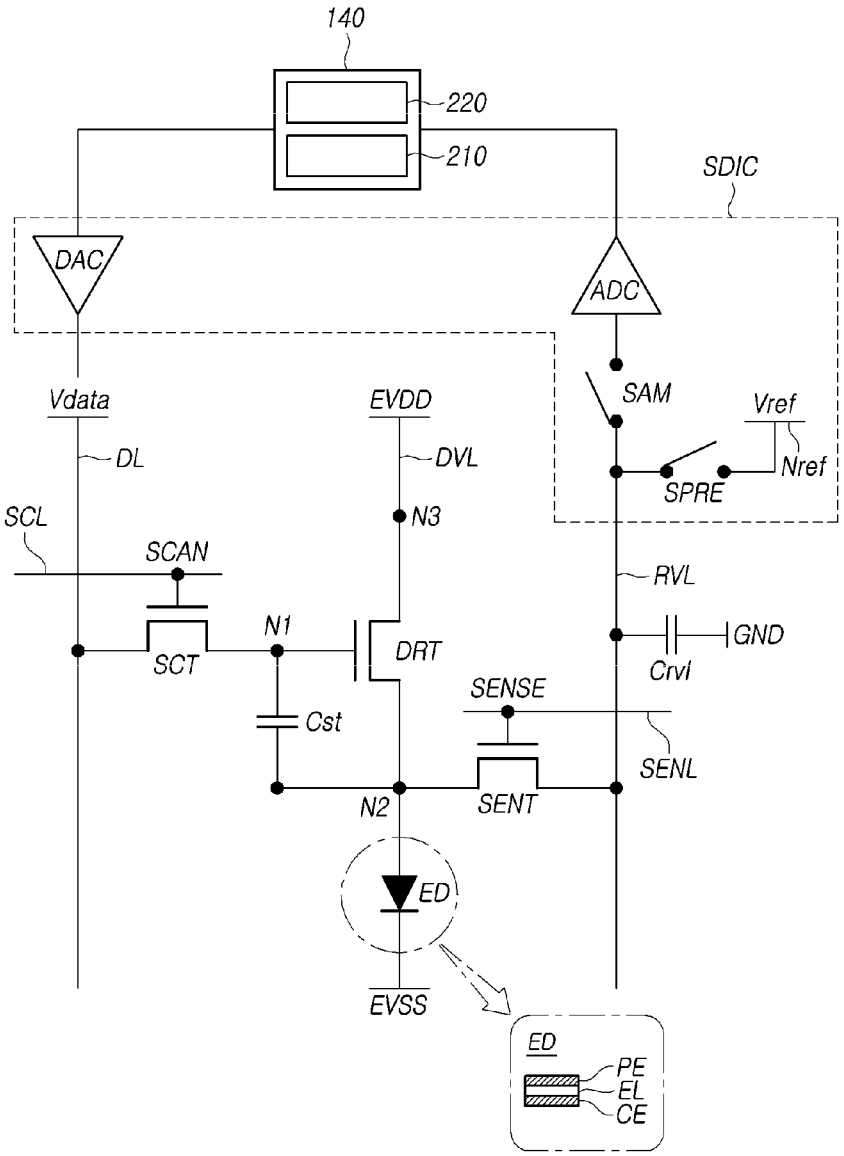
FIG. 2 schematically illustrates an equivalent circuit of a subpixel and a configuration for compensating for characteristic values of the subpixel according to embodiments of the present disclosure.

FIG. 2 schematically illustrates an equivalent circuit of a subpixel SP and a configuration for compensating for characteristic values of the subpixel SP according to embodiments.

Referring to FIG. 2, each of the plurality of subpixels SP can include an emitting element ED, a driving transistor DRT, a scan transistor SCT, and a storage capacitor Cst.

The emitting element ED can include a pixel electrode PE, a common electrode CE, and an emissive layer EL positioned between the pixel electrode PE and the common electrode CE.

The pixel electrode PE of the emitting element ED can be an electrode disposed on each of the subpixels SP, and the common electrode CE can be an electrode commonly disposed on all of the subpixels SP. Here, the pixel electrode PE can be an anode, and the common electrode CE can be a cathode. In contrast, the pixel electrode PE can be a cathode, and the common electrode CE can be an anode. The common electrode CE of the emitting element ED may receive a base voltage EVSS.

For example, the emitting element ED can be an organic light-emitting diode (OLED), a light-emitting diode (LED), or a quantum dot emitting element.

The driving transistor DRT can include a first node N1, a second node N2, a third node N3, and the like as transistors for driving the emitting element ED.

The first node N1 of the driving transistor DRT can be a gate node of the driving transistor DRT and electrically connected to a source node or a drain node of the scan transistor SCT. The second node N2 of the driving transistor DRT can be a source node or a drain node of the driving transistor DRT, electrically connected to a source node or a drain node of a sensing transistor SENT, and electrically connected to the pixel electrode PE of the emitting element ED. The third node N3 of the driving transistor DRT can be electrically connected to a driving voltage line DVL through which a driving voltage EVDD is supplied.

The scan transistor SCT can be controlled by a scan pulse SCAN that is a type of gate signal and electrically connected to the first node N1 of the driving transistor DRT and a data line DL. That is, the scan transistor SCT can be turned on or off by the scan pulse SCAN supplied through a scan line SCL that is a type of gate line GL, and control the connection between the data line DL and the first node N1 of the driving transistor DRT.

The scan transistor SCT can be turned on by the scan pulse SCAN having a turn-on level voltage to transfer a data signal Vdata supplied through the data line DL to the first node N1 of the driving transistor DRT.

Here, when the scan transistor SCT is an N-type transistor, the turn-on level voltage of the scan pulse SCAN can be a high level voltage. When the scan transistor SCT is a P-type transistor, the turn-on level voltage of the scan pulse SCAN can be a low level voltage.

The storage capacitor Cst can be electrically connected to the first node N1 and the second node N2 of the driving transistor DRT. The storage capacitor Cst is charged with an amount of electric charge corresponding to the voltage difference between both ends of the storage capacitor Cst, and serves to maintain the voltage difference between the both ends for a predetermined frame time. Thus, for the predetermined frame time, the corresponding subpixel SP can emit light.

Referring to FIG. 2, each of the plurality of subpixels SP disposed in the display panel 110 of the display device 100 according to embodiments can further include the sensing transistor SENT.

The sensing transistor SENT can be controlled by a sensing pulse SENSE that is a type of gate signal and electrically connected to the second node N2 of the driving transistor DRT and a reference voltage line RVL. In other words, the sensing transistor SENT can be turned on or off by the sensing pulse SENSE supplied through a sense line SENL that is a type of gate line GL to control the connection between the sensing line SL and the second node N2 of the driving transistor DRT.

The second node N2 of the driving transistor DRT will also be referred to as a sensing node.

The sensing transistor SENT can be turned on by the sensing pulse SENSE having the turn-on level voltage to transfer a reference voltage Vref supplied through the reference voltage line RVL to the second node N2 of the driving transistor DRT. The reference voltage line RVL will also be referred to as a sensing line.

An initialization switch SPRE switches an electrical connection between the reference voltage line RVL and a reference voltage supply node Nref. The initialization switch SPRE includes one end electrically connected to the reference voltage line RVL and the other end electrically connected to the reference voltage supply node Nref.

The reference voltage Vref is applied to the reference voltage supply node Nref.

In addition, the sensing transistor SENT can be turned on by the sensing pulse SENSE having a turn-on level voltage to transfer a voltage on the second node N2 of the driving transistor DRT to the reference voltage line RVL.

Here, when the sensing transistor SENT is an N-type transistor, the turn-on level voltage of the sensing pulse SENSE can be a high level voltage. When the sensing transistor SENT is a P-type transistor, the turn-on level voltage of the sensing pulse SENSE can be a low level voltage.

The function of the sensing transistor SENT to transfer the voltage of the second node N2 of the driving transistor DRT to the reference voltage line RVL can be used in driving for sensing the characteristic values of the subpixel SP. In this situation, the voltage transferred to the reference voltage line RVL can be a voltage used to calculate the characteristic values of the subpixel SP or a voltage in which the characteristic values of the subpixel SP are reflected.

Each of the driving transistor DRT, the scan transistor SCT, and the sensing transistor SENT can be an N-type transistor or a P-type transistor. In embodiments, for the sake of brevity, each of the driving transistor DRT, the scan transistor SCT, and the sensing transistor SENT will be illustrated as being an N-type transistor as an example.

The storage capacitor Cst can be an external capacitor intentionally designed to be provided outside of the driving transistor DRT, rather than a parasitic capacitor (e.g. Cgs or Cgd), e.g., an internal capacitor existing between the gate node and the source node (or the drain node) of the driving transistor DRT.

The scan line SCL and the sense line SENL can be different gate lines GL. In this situation, the scan pulse SCAN and the sensing pulse SENSE can be different gate signals, and the on-off timing of the scan transistor SCT and the on-off timing of the sensing transistor SENT in a single subpixel SP can be independent of each other. That is, the on-off timing of the scan transistor SCT and the on-off timing of the sensing transistor SENT in a single subpixel SP can be the same or different.

Alternatively, the scan line SCL and the sense line SENL can be the same gate line GL.

The gate node of the scan transistor SCT and the gate node of the sensing transistor SENT in a single subpixel SP can be connected to a single gate line GL. In this situation, the scan pulse SCAN and the sensing pulse SENSE can be the same gate signal, and the on-off timing of the scan transistor SCT and the on-off timing of the sensing transistor SENT in a single subpixel SP can be the same.

The structure of the subpixels SP illustrated in FIG. 2 is for illustrative purposes only, and can be variously modified in form to further include one or more transistors or one or more capacitors.

In addition, in FIG. 2, the subpixel structure has been described by assuming that the display device 100 is a self-emissive display device. Alternatively, when the display device 100 is a liquid crystal display (LCD), each of the subpixels SP can include a transistor, a pixel electrode, and the like.

Referring to FIG. 2, the display device 100 according to embodiments can include a line capacitor Crvl. The line capacitor Crvl can be a capacitor device, one end of which is electrically connected to the reference voltage line RVL, or a parasitic capacitor formed on the reference voltage line RVL.

Referring to FIG. 2, a source driving integrated circuit SDIC can include an analog-to-digital converter ADC and a sampling switch SAM.

The reference voltage line RVL can be electrically connected to the analog-to-digital converter ADC. The analog-to-digital converter ADC can sense a voltage on the reference voltage line RVL. The voltage sensed by the analog-to-digital converter ADC can be a voltage in which the characteristic values of the subpixel SP are reflected.

In the present disclosure, the characteristic values of the subpixel SP can be characteristic values of the driving transistor DRT or the emitting element ED. The characteristic values of the driving transistor DRT can include the threshold voltage, mobility, and the like of the driving transistor DRT. The characteristic values of the emitting element ED can include the threshold voltage of the emitting element ED.

The analog-to-digital converter ADC can receive an analog voltage, convert the analog voltage into a digital value, and output the digital value to the controller 140.

The sampling switch SAM can be positioned between the analog-to-digital converter ADC and the reference voltage line RVL. The sampling switch SAM can switch an electrical connection between the reference voltage line RVL and the analog-to-digital converter ADC.

The controller 140 can include a storage 210 in which information regarding the characteristic values of the subpixel SP is stored and a compensation circuit 220 performing a calculation to compensate for changes in the characteristic values of the subpixel SP based on the information stored in the storage 210.

Information for compensating for the characteristic values of the subpixel SP can be stored in the storage 210. For example, the storage 210 can store information regarding the threshold voltage and mobility of the driving transistor DRT of each of the plurality of subpixels SP and information regarding the threshold voltage of the emitting element ED included in the subpixel SP.

Information regarding the threshold voltage of the emitting element ED can be stored in a lookup table (LUT).

The compensation circuit 220 calculates the degree of change in the characteristic values of the corresponding subpixel SP based on the digital value input from the analog-to-digital converter ADC and the information regarding the characteristic values of the subpixel SP stored in the storage 210. The compensation circuit 220 updates the information regarding the characteristic values of the subpixel SP stored in the storage 210.

The controller 140 drives the data driving circuit 120 by compensating for image data by reflecting the change in the characteristic values of the subpixel SP calculated by the compensation circuit 220.

A data signal Vdata in which the change in the characteristic values of the subpixel SP is reflected can be output through a corresponding data line DL by a digital-to-analog converter DAC.

The above-described process of sensing a change in the characteristic values of the subpixel SP and compensating for the change will also be referred to as a "subpixel characteristic values compensation process."

Figure 3:
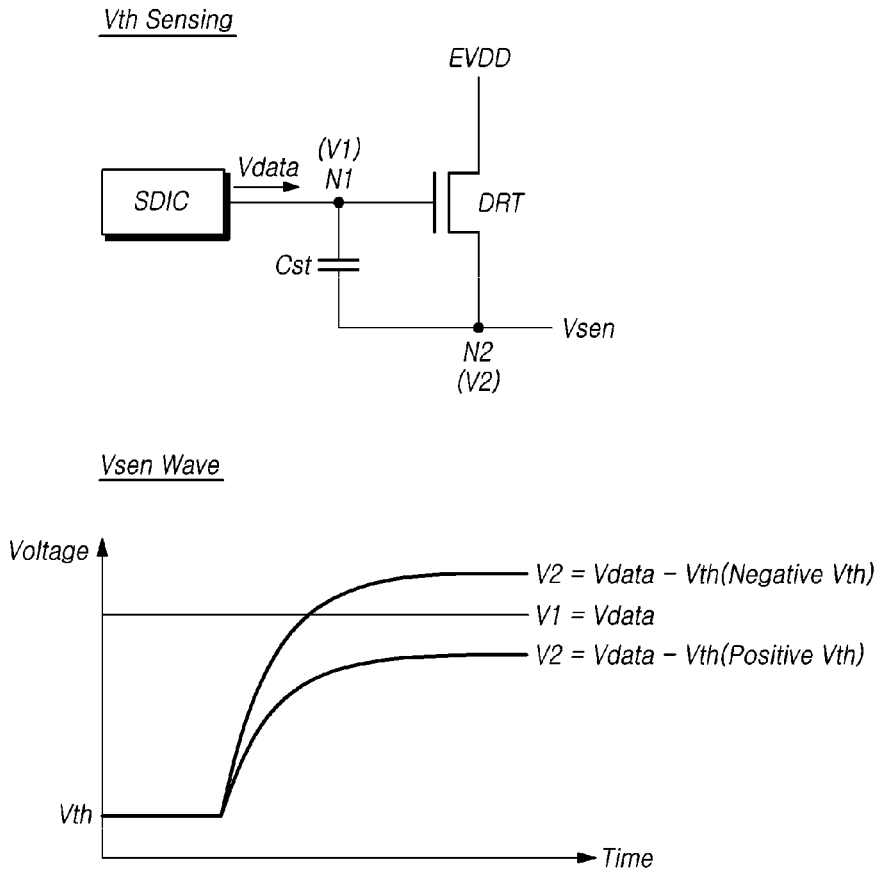
FIG. 3 illustrates a driving method of threshold voltage sensing for a driving transistor in the display device according to embodiments of the present disclosure.

FIG. 3 illustrates a driving method of threshold voltage sensing Vth Sensing for a driving transistor in the display device according to embodiments.

The driving of the driving transistor DRT for the threshold voltage sensing Vth Sensing can be a sensing process including an initialization operation, a tracking operation, and a sampling operation.

The initialization operation is an operation to initialize the first node N1 and the second node N2 of the driving transistor DRT.

In the initialization operation, the scan transistor SCT and the sensing transistor SENT are turned on, and the initialization switch SPRE is turned off.

Thus, each of the first node N1 and the second node N2 of the driving transistor DRT is initialized with a threshold voltage sensing driving data signal Vdata and a reference voltage Vref (V1=Vdata, V2=Vref).

The tracking operation is an operation to change a voltage V2 on the second node N2 of the driving transistor DRT until the voltage on the second node N2 of the driving transistor DRT is a voltage reflecting the threshold voltage or a change in the threshold voltage.

That is, the tracking operation is an operation to track the voltage on the second node N2 of the driving transistor DRT in which the threshold voltage or a change in the threshold voltage can be reflected.

In the tracking operation, the initialization switch SPRE or the sensing transistor SENT is turned off, and thus the second node N2 of the driving transistor DRT is floated.

Consequently, the voltage on the second node N2 of the driving transistor DRT has been increased.

As the voltage V2 on the second node N2 of the driving transistor DRT increases, the incremental increase of the voltage V2 is gradually reduced and then the voltage V2 becomes saturated.

The saturated voltage on the second node N2 of the driving transistor DRT can correspond to the difference between the data signal Vdata and the threshold voltage Vth or the difference between the signal Vdata and a threshold voltage deviation AVth.

When the voltage V2 on the second node N2 of the driving transistor DRT is saturated, the sampling operation can be performed.

The sampling operation is an operation to measure a voltage reflecting the threshold voltage of the driving transistor DRT or a change in the threshold voltage. In the sampling operation, the analog-to-digital converter ADC senses a voltage on the reference voltage line RVL, e.g., the voltage V2 on the second node N2 of the driving transistor DRT.

A voltage Vsen sensed by the analog-to-digital converter ADC can be a voltage Vdata-Vth obtained by subtracting the threshold voltage Vth from the data signal Vdata or a voltage Vdata-AVth obtained by subtracting the threshold voltage deviation AVth from the data signal Vdata. Here, the Vth can be a positive threshold voltage or a negative threshold voltage.

Figure 4:
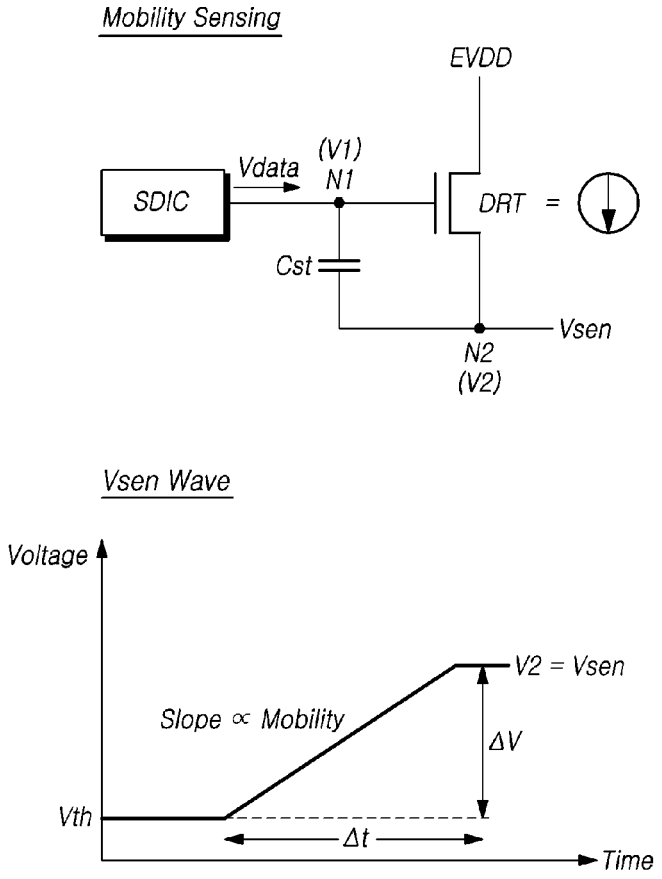
FIG. 4 illustrates a driving method of mobility sensing for the driving transistor in the display device according to embodiments of the present disclosure.

FIG. 4 illustrates a driving method of mobility sensing (Mobility Sensing) for the driving transistor DRT in the display device according to embodiments.

The driving of the mobility sensing (Mobility Sensing) for the driving transistor DRT can be performed as a sensing process including an initialization operation, a tracking operation, and a sampling operation.

The initialization operation is an operation to initialize the first node N1 and the second node N2 of the driving transistor DRT.

In the initialization operation, the scan transistor SCT and the sensing transistor SENT are turned on, and the initialization switch SPRE is turned off.

Thus, each of the first node N1 and the second node N2 of the driving transistor DRT is initialized with a mobility sensing driving data signal Vdata and a reference voltage Vref (V1=Vdata, V2=Vref).

The tracking operation is an operation to change the voltage V2 on the second node N2 of the driving transistor DRT until the voltage on the second node N2 of the driving transistor DRT is a voltage reflecting the mobility or a change in the mobility.

That is, the tracking operation is an operation to track the voltage on the second node N2 of the driving transistor DRT in which the mobility or a change in the mobility can be reflected.

In the tracking operation, the initialization switch SPRE or the sensing transistor SENT is turned off, and thus the second node N2 of the driving transistor DRT is floated. Here, the scan transistor SCT is turned off, and thus the first node N1 of the driving transistor DRT can also be floated.

Consequently, the voltage V2 on the second node N2 of the driving transistor DRT starts to increase.

The increasing rate of the voltage V2 on the second node N2 of the driving transistor DRT varies depending on the current capability (e.g., mobility) of the driving transistor DRT.

The greater the current capability (e.g., mobility) of the driving transistor DRT, the faster the voltage V2 on the second node N2 of the driving transistor DRT is increased.

After the tracking operation has been performed for a predetermined time Δt, e.g., after the voltage V2 on the second node N2 of the driving transistor DRT has been increased for the predetermined time Δt, the sampling operation can be performed.

During the tracking operation, the increasing rate of the voltage V2 of the second node N2 of the driving transistor DRT corresponds to a voltage change ΔV for a predetermined time Δt.

In the sampling operation, the sampling switch SAM is turned on, and thus the analog-to-digital converter ADC and the reference voltage line RVL are electrically connected to each other.

Consequently, the analog-to-digital converter ADC senses a voltage on the reference voltage line RVL, e.g., the voltage V2 on the second node N2 of the driving transistor DRT.

The voltage Vsen sensed by the analog-to-digital converter ADC is a voltage increased by the voltage change ΔV for the predetermined time Δt, and corresponds to the mobility.

In response to the driving of the threshold voltage sensing or the mobility sensing described above with reference to FIGS. 3 and 4, the analog-to-digital converter ADC converts the voltage Vsen sensed for the threshold voltage sensing or the mobility sensing into a digital value, generates sensing data including the converted digital value (e.g., a sensed value), and outputs the sensing data.

The sensing data output by the analog-to-digital converter ADC can be provided to the compensation circuit 220. In some situations, the sensing data can be provided to the compensation circuit 220 through the storage 210.

The compensation circuit 220 can determine the characteristic values (e.g., threshold voltage and mobility) of the driving transistor DRT in a corresponding subpixel or a change in the characteristic values (e.g., a change in the threshold voltage and a change in the mobility) of the driving transistor DRT based on the sensing data provided by the analog-to-digital converter ADC, and perform a characteristic values compensation process.

Here, the change in the characteristic values of the driving transistor DRT can indicate that the current sensing data has been changed from the previous sensing data or the current sensing data has been changed from the initial compensation data.

Thus, comparing the characteristic values or changes in the characteristic values among driving transistors DRT, a deviation in characteristic values among the driving transistors DRT can be determined. When changes in the characteristic values among the driving transistors DRT indicate that the current sensing data has been changed from the initial compensation data, the deviation in characteristic values among the driving transistors DRT (e.g., a luminance deviation among the subpixels) can be determined from the changes in the characteristic values among the driving transistors DRT.

Here, the compensation data can be initially-set data that was previously set and stored when the display device was fabricated.

The characteristic values compensation process can include a threshold voltage compensation process to compensate for the threshold voltage of the driving transistor DRT and a mobility compensation process to compensate for the mobility of the driving transistor DRT.

The threshold voltage compensation process can include a process of calculating compensation data for compensating for the threshold voltage or the threshold voltage deviation (e.g., threshold voltage changes), storing the calculated compensation data in the storage 210, and changing the corresponding image data DATA with the calculated compensation data.

The mobility compensation process can include a process of calculating compensation data for compensating for the mobility or the mobility deviation (e.g., mobility changes), storing the calculated compensation data in the storage 210, and changing the corresponding image data DATA with the calculated compensation data.

The compensation circuit 220 can change the image data DATA by the threshold voltage compensation process or the mobility compensation process and provide the changed image data DATA to a corresponding source driving integrated circuit SDIC in the data driving circuit 120.

Consequently, the corresponding source driving integrated circuit SDIC converts the data changed by the compensation circuit 220 into a data signal through the digital-to-analog converter DAC, and supplies the data signal to the corresponding subpixel, so that the characteristic values (e.g., the threshold voltage and mobility) of the subpixel are actually compensated for.

Figure 5:
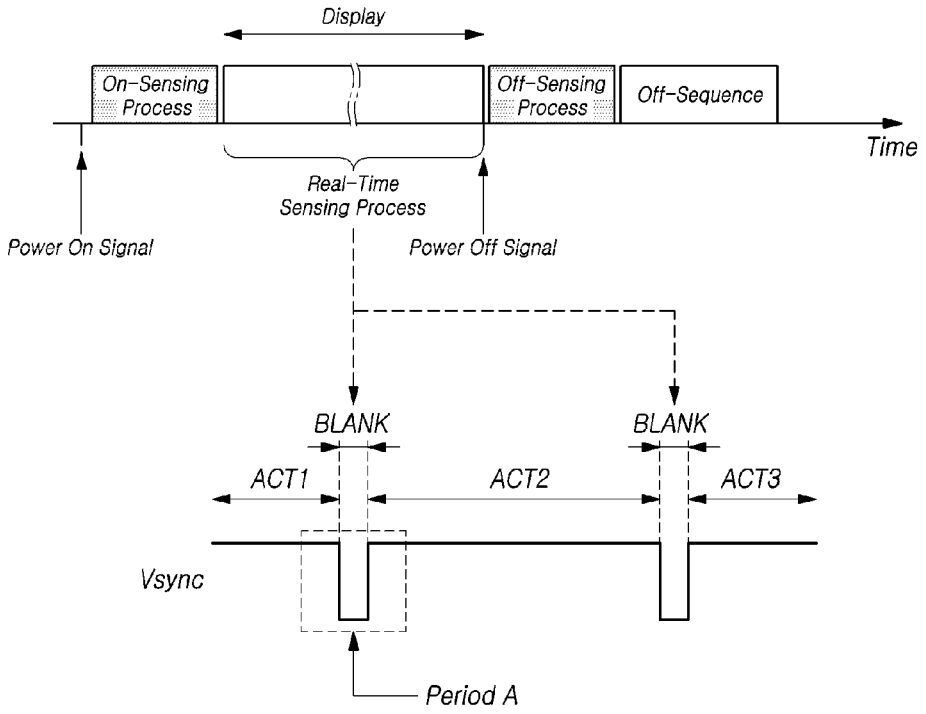
FIG. 5 illustrates driving timing of the display device according to embodiments of the present disclosure.

FIG. 5 illustrates driving timing of the display device according to embodiments.

Referring to FIG. 5, when a power-on signal is generated, the display device according to embodiments can perform one compensation process of the above-described compensation processes. Such a sensing process will be referred to as an "on-sensing process."

Referring to FIG. 5, when a power-off signal is generated, the display device according to embodiments can perform one compensation process of the above-described compensation processes before an off-sequence takes place, such as powering the device off. Such a sensing process will be referred to as an "off-sensing process."

Referring to FIG. 5, the display device according to embodiments can perform one compensation process of the above-described compensation processes during display driving, before the generation of the power-on signal, and after the generation of the power-off signal. Such a sensing process will be referred to as a "real-time (RT) sensing process."

The Real-time sensing process can be performed during every blank period BLANK between active periods ACT with respect to a vertical synchronization signal Vsync.

The display device according to embodiments can perform the Real-time sensing process in a blank period BLANK between a first active period ACT1 in which an image of a first frame is displayed on the display panel and a second active period ACT2 in which an image of a second frame is displayed on the display panel.

The display device according to embodiments can perform the Real-time sensing process in a blank period BLANK between the second active period ACT2 in which the image of the second frame is displayed on the display panel and a third active period ACT3 in which an image of a third frame is displayed on the display panel.

The driving of the threshold voltage sensing illustrated in FIG. 3 can be performed in a period before the power-off signal is generated and the off-sequence, such as power off, is performed.

The driving of the mobility sensing illustrated in FIG. 3 can be performed in a period before the generation of the power-off signal, which is after the generation of the power-on signal.

Figure 6:
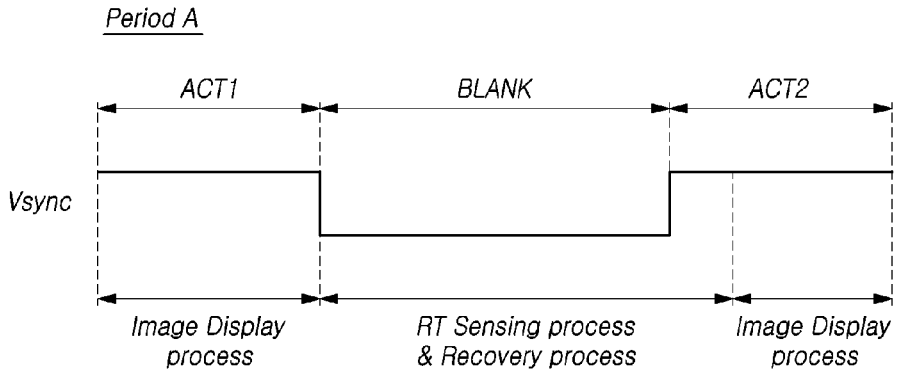
FIG. 6 illustrates period A in the timing diagram of FIG. 5 according to an embodiment of the present disclosure.

FIG. 6 illustrates period A in the timing diagram of FIG. 5.

Referring to FIG. 6, after the active period ACT1 in which the image of the first frame is displayed on the display panel, the Real-time sensing process can be performed.

After the Real-time sensing process is performed, a real-time recovery process can be performed.

While the real-time recovery process is being performed, a data signal for sensing the characteristic values of the subpixel SP is applied to one subpixel SP among the plurality of subpixels SP, in order to sense the characteristic values of the subpixel SP.

In order to instantaneously increase the voltage on the sensing node of the subpixel SP during the blank period BLANK, the data signal having a high voltage level is instantaneously applied to a data line DL.

Such a data signal having a high voltage level can have an effect on displaying an image of a subsequent frame, and thus the recovery process can be performed after the real-time sensing process is performed.

The recovery process can be performed in some period of the active periods ACT of the vertical synchronization signal Vsync. The recovery process can be performed in a blank period BLANK of the vertical synchronization signal Vsync.

When the recovery process is performed in the blank period BLANK, the real-time sensing process can be performed in some period in the blank period BLANK, and the recovery process can be performed in the remaining period in the blank period BLANK.

Figure 7:
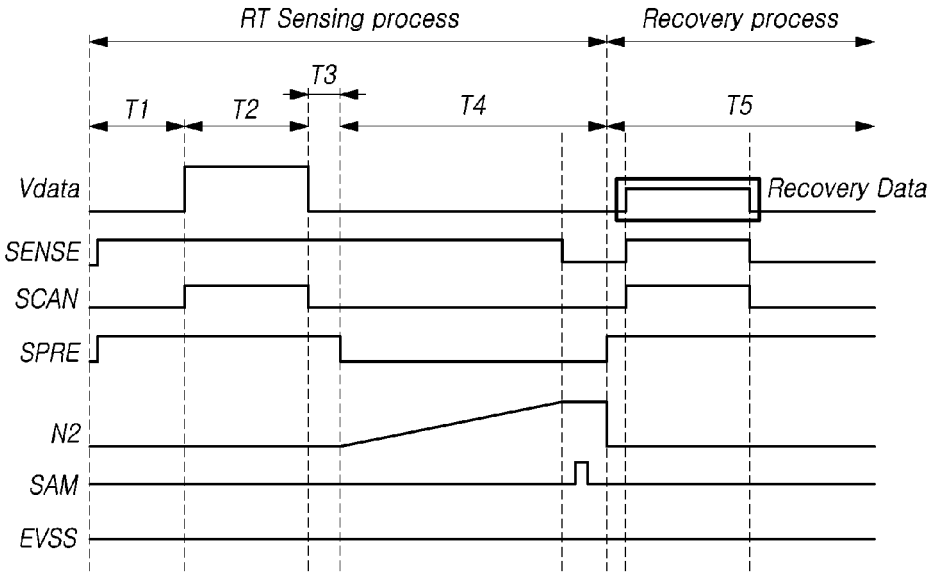
FIG. 7 illustrates driving timing of the real-time sensing process and the recovery process in the display device according to embodiments of the present disclosure.

FIG. 7 illustrates driving timing of the real-time sensing process and the recovery process in the display device according to embodiments.

The real-time sensing process can be mobility sensing driving.

As described above, the mobility sensing driving for the driving transistor DRT can be performed in a sensing process including an initialization operation, a tracking operation, and a sampling operation.

The initialization operation is an operation to initialize the first node N1 and the second node N2 of the driving transistor DRT.

Referring to FIG. 7, the initialization operation can include a first period T1, a second period T2, and a third period T3.

In the initialization operation, the scan transistor SCT and the sensing transistor SENT are turned on, and the initialization switch SPRE is turned off.

Consequently, the first node N1 and the second node N2 of the driving transistor DRT are initialized with the data signal Vdata for the driving of the mobility sensing and the reference voltage Vref, respectively (V1=Vdata, V2=Vref).

The tracking operation is an operation to change the voltage V2 on the second node N2 of the driving transistor DRT until the voltage on the second node N2 of the driving transistor DRT is a voltage reflecting the mobility or a change in the mobility. The sampling operation is an operation to sense the voltage on the second node N2 of the driving transistor DRT reflecting the mobility of the driving transistor DRT or the change in the mobility.

Here, sensing the voltage on the second node N2 of the driving transistor DRT can be expressed as sensing the reference voltage line RVL electrically connected to the second node N2 of the driving transistor DRT.

Referring to FIG. 7, a fourth period T4 can include the tracking operation and the sampling operation.

In a fifth period T5 after the fourth period T4, the recovery process can be performed.

While the recovery process is being performed, the voltage level of a recovery signal Recovery Data applied to a data line DL can be lower than the voltage level of the data signal Vdata applied to the data line DL during the previous second period T2.

The voltage level of the recovery signal Recovery Data can be lower than the voltage level of the data signal for the mobility sensing.

During a portion of the fifth period T5, the recovery signal Recovery Data is supplied to the data line DL.

While the recovery signal Recovery Data is being supplied to the data line DL, a scan pulse SCAN having a turn-on level voltage can be supplied to the scan transistor SCT, and a sensing pulse SENSE having a turn-on level voltage can be supplied to the sensing transistor SENT.

During the fifth period T5, the initialization switch SPRE can be turned on.

Consequently, the voltage on the second node N2 of the driving transistor DRT can be initialized with the reference voltage Vref.

Figure 8:
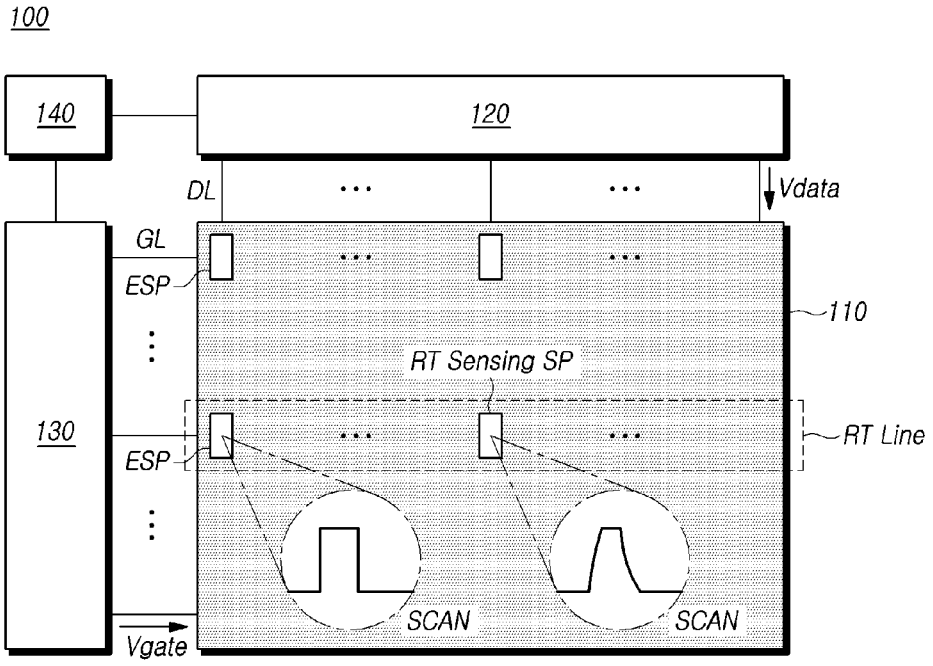
FIG. 8 illustrates a phenomenon in which a real-time sensing line is visually recognized after a recovery signal is input to subpixels according to a comparative example.

FIG. 8 illustrates a comparative example, in which a phenomenon regarding a real-time sensing line RT Line is able to be visually recognized by a user after a recovery signal is input to subpixels SP.

Referring to FIG. 8, the display device 100 can perform the recovery process after the real-time sensing process.

In the recovery process period, the recovery signal is input to a subpixel RT Sensing SP sensed during the period of the real-time sensing process.

Meanwhile, during the period of the recovery process, the recovery signal can be input to each of subpixels SP to which a gate signal the same as the gate signal applied to the subpixel RT Sensing SP sensed during the period of the real-time sensing process is applied.

In other words, the recovery signal can be input to each of subpixels SP to which a gate signal the same as the gate signal applied to the subpixel RT Sensing SP sensed during the period of the real-time sensing process is applied.

Consequently, the recovery signal is input to each of the subpixel RT Sensing SP sensed during the period of the real-time sensing process and edge subpixels ESP to each of which the gate signal applied to the subpixel RT Sensing SP is input.

Here, the edge subpixels ESP can refer to subpixels SP positioned adjacent to or near the gate driving circuit 130. When two or more subpixels SP form a single pixel, the edge subpixels ESP can refer to subpixels SP included in pixels disposed adjacent to or near the gate driving circuit 130.

The gate driving circuit 130 supplies scan signals SCAN to a plurality of subpixels SP. Due to capacitor components formed between the gate lines GL and a variety of signal lines of the display panel 110, the scan signal SCAN supplied to a subpixel SP is time-delayed as the distance between the gate driving circuit 130 and the subpixel SP increases (e.g., subpixels located farther away from the gate driving circuit 130 can experience a longer delay).

Thus, the gate driving circuit 130 supplies the scan signal SCAN to the gate line GL by considering the time delay so that the subpixel SP spaced far away from the gate driving circuit 130 can also be sufficiently charged with the recovery signal.

While the recovery signal is being applied, a scan signal SCAN having substantially no time delay is input to the edge subpixels ESP adjacent to the gate driving circuit 130. A scan signal SCAN having a turn-on level voltage can be applied to the edge subpixels ESP for a relatively long time, and a relatively large amount of current can flow through the emitting elements of the edge subpixels ESP (e.g., subpixels located near the gate driving circuit 130 can receive more power than subpixels located farther away on the opposite side of the display panel).

While the recovery signal is being applied, a scan signal SCAN having a relatively large degree of time delay is applied to subpixels SP spaced further away from the gate driving circuit 130. A scan signal SCAN having a turn-on level voltage can be applied for a relatively short time to subpixels SP spaced further away from the gate driving circuit 130, and a relatively short amount of current can flow through the emitting elements of the subpixels SP.

Consequently, in the display panel 110, the edge subpixels ESP are displayed relatively brightly, whereas the subpixels SP spaced far away from the gate driving circuit 130 are displayed to be relatively dark in comparison.

A line of subpixels SP to which the same gate signal as input to the subpixel RT Sensing SP sensed during the period of the real-time sensing process is input will be referred to as a real-time sensing line RT Line.

In particular, when the real-time sensing line RT Line displays a low gray value, the edge subpixels ESP can appear more prominent to a user. This phenomenon will be referred to as "real-time sensing line appearance."

The real-time sensing line appearance is problematic, since the real-time sensing line appearance obstructs the display device 100 from realizing a perfect black screen and degrades the quality of display.

Thus, there is demand for a method of performing the real-time sensing process by considering whether the gray value of the edge subpixels ESP in image data of a subsequent frame is low gray or high gray, and which can prevent edge subpixels ESP from appearing more prominent to a user during real-time sensing.

Figure 9:
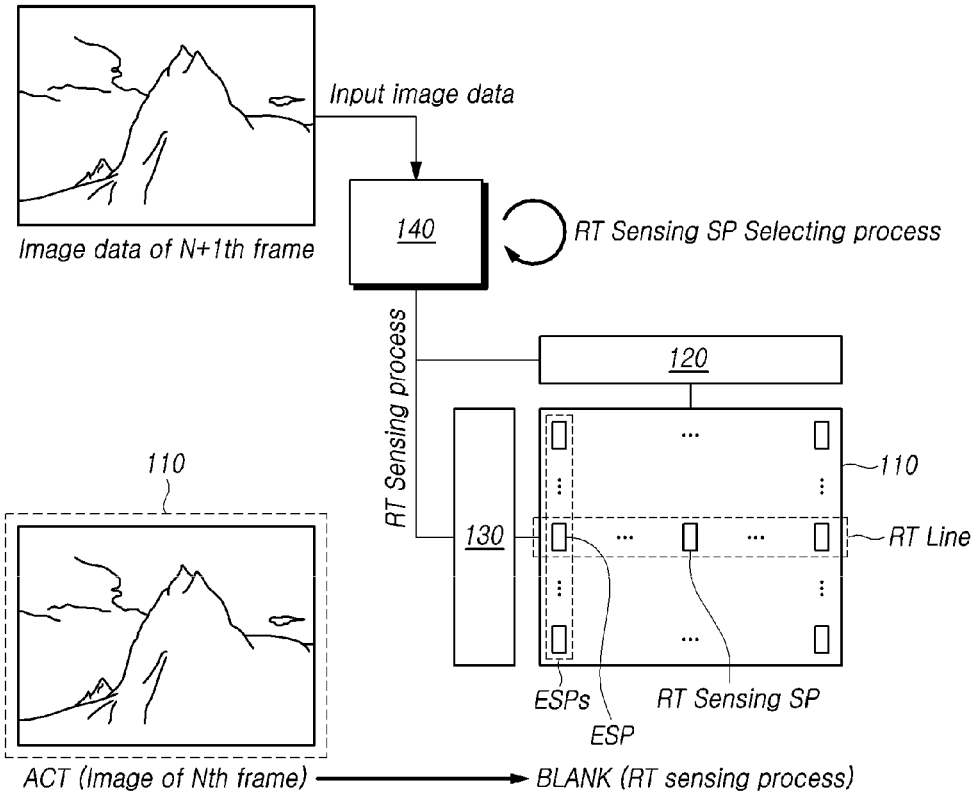
FIG. 9 illustrates selection of a real-time sensing subpixel SP using image data of a subsequent frame in the display device according to embodiments of the present disclosure.

FIG. 9 illustrates selection of a real-time sensing subpixel SP using image data of a subsequent frame in the display device according to embodiments.

Referring to FIG. 9, while the display panel 110 is displaying an image of the Nth frame (where N is a positive integer greater than or equal to 1), image data of the (N+1)th frame is input to the timing controller 140.

The timing controller 140 can perform a "real-time sensing subpixel selecting process" by receiving the image data of the (N+1)th frame, in order to device which subpixels to sense or not to sense (e.g., subpixels not selected for sensing can be sensed at a later time when gray values of a subsequent frame are more favorable, in which sensing during or immediately before dark periods or dark portions can be avoided, and rescheduled for a later time).

The timing controller 140 can select whether or not to perform real-time sensing during a blank period BLANK immediately after an active period ACT of the Nth frame by performing the real-time sensing subpixel selecting process.

The timing controller 140 can select whether or not to perform the real-time sensing process during the blank period BLANK immediately after the active period ACT of the Nth frame based on the gray values of all of edge subpixels ESPs of the image data of the (N+1)th frame.

When the gray value of any edge subpixel ESP among all of the edge subpixels ESPs of the image data of the (N+1)th frame is determined to be greater than or equal to a predetermined gray value, the timing controller 140 decides to perform the real-time sensing process during the blank period BLANK immediately after the active period ACT of the Nth frame.

The timing controller 140 selects an edge subpixel ESP, the gray value of which is greater than or equal to the predetermined gray value, and subpixels SP, to which the same gate signal as input to the edge subpixel ESP is input, as a real-time sensing line RT Line.

The timing controller 140 can select one subpixel SP among the plurality of subpixels SP included in the selected real-time sensing line RT Line as a real-time sensing subpixel RT Sensing SP.

The timing controller controls the data driving circuit 120 while the real-time sensing process is being performed.

The data driving circuit 120 can supply a data signal for the mobility sensing to the selected real-time sensing subpixel RT Sensing SP in a period in which the real-time sensing process is performed.

The timing controller 140 controls the gate driving circuit 130 during the period of the real-time sensing process.

In the period in which the real-time sensing process is performed, the gate driving circuit 130 can supply the gate signal to the selected real-time sensing subpixel RT Sensing SP in timing.

In the period of the real-time sensing process, the data driving circuit 120 senses a sensing node of the selected real-time sensing subpixel RT Sensing SP and receives an analog voltage.

In the period of the real-time sensing process, the data driving circuit 120 can convert the input analog voltage into a digital value and output the converted digital value to the timing controller 140.

The timing controller 140 can compensate for a change in the characteristic values of the selected real-time sensing subpixel RT Sensing SP using the input digital value.

In the period of the recovery process after the real-time sensing process, the data driving circuit 120 can supply the recovery signal to the subpixels SP of the real-time sensing line RT Line.

In the period of the recovery process after the real-time sensing process, the gate driving circuit 130 can supply the gate signal to the subpixels SP of the real-time sensing line RT Line.

In an image display period after the period of the recovery process, the data driving circuit 120 inputs an image display data signal to the subpixels SP of the real-time sensing line RT Line.

Here, the data signal input to the subpixels SP of the real-time sensing line RT Line is a data signal for displaying the image data of the (N+1)th frame.

The data signal for displaying an image, the gray value of which is the equal to or greater than a predetermined gray value, is input to the edge subpixel ESP included the real-time sensing line RT Line.

The edge subpixel ESP of the real-time sensing line RT Line displays a high gray image during the period of the recovery process and also displays a high gray image during a period in which the image based on the image data of the (N+1)th frame is displayed.

Consequently, the phenomenon in which the edge subpixel ESP of the real-time sensing line RT Line is visually recognized by a user can be reduced and/or prevented.

That is, since the real-time sensing subpixel selecting process is performed in consideration of the image data of the (N+1)th frame (e.g., the next frame), the appearance of the real-time sensing line RT Line can be reduced and/or prevent. In other words, the upcoming display conditions (e.g., upcoming bright scene or portion, or upcoming dark scene or portion) can be considered when deciding whether or not to perform sensing on a given line of subpixels or to delay sensing until a later time when viewing conditions are more favorable.

Figure 10A:
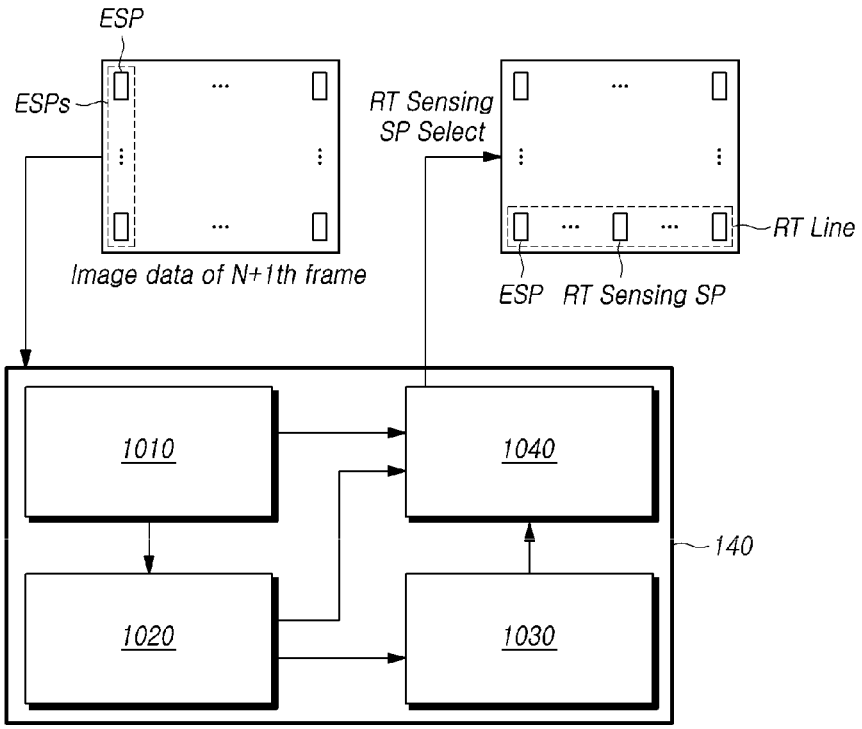
FIGS. 10A and 10B illustrate the timing controller that selects or does not select the real-time sensing subpixel based on image data of a subsequent frame according to embodiments of the present disclosure.
Figure 10B:
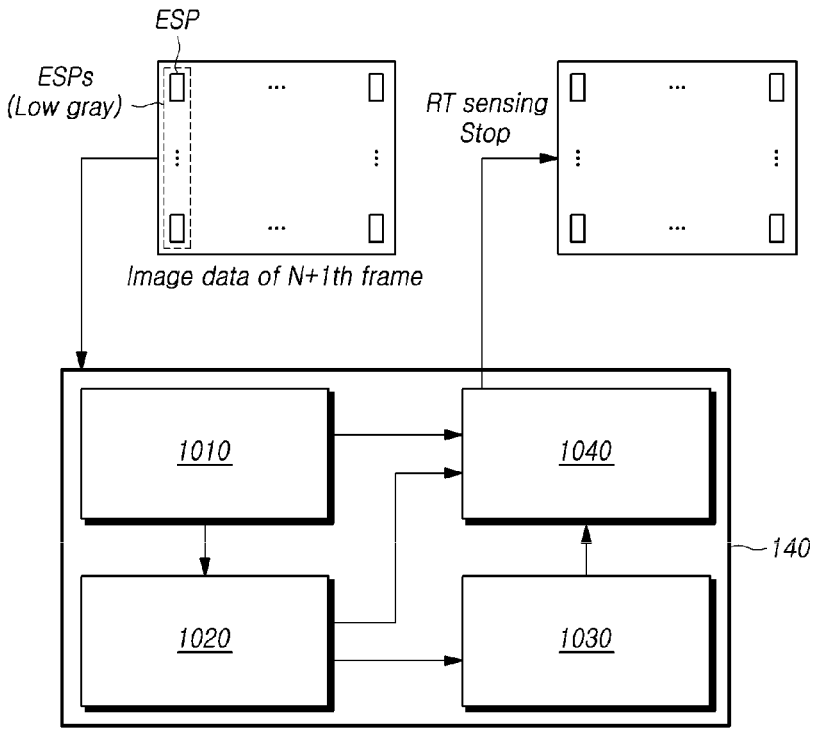

FIGS. 10A and 10B illustrate the timing controller 140 according to embodiments that selects or does not select the real-time sensing subpixel RT Sensing SP based on image data of a subsequent frame.

Referring to FIG. 10A, the timing controller 140 according to embodiments can include an image data storage 1010, an edge subpixel information calculator 1020, a real-time sensing determiner 1030, and a real-time sensing subpixel selector 1040.

While the image data of the Nth frame is being displayed on the display panel 110, the timing controller 140 can receive the image data of the (N+1)th frame. That is, the timing controller 140 can receive the image data of the subsequent frame of the image displayed on the display panel.

The image data storage 1010 stores, from the input image data of the (N+1)th frame, values matching positions of the plurality of subpixels SP and gray values according to the positions of the plurality of subpixels SP.

The image data storage 1010 stores the gray value of each of the plurality of subpixels SP of the (N+1)th frame.

The edge subpixel information calculator 1020 can compare gray values of all of the edge subpixels ESPs with a predetermined gray value and calculate comparison result values for the edge subpixels ESP.

When the gray value of an edge subpixel ESP is less than the predetermined gray value, the edge subpixel information calculator 1020 calculates a comparison result value matching a low gray condition for the corresponding edge subpixel ESP. For example, a comparison result value "0" can be calculated for the corresponding edge subpixel ESP in this type of situation and sensing can be delayed or prevented.

When the gray value of an edge subpixel ESP is equal to or greater than the predetermined gray value, the edge subpixel information calculator 1020 calculates a comparison result value matching a high gray condition for the corresponding edge subpixel ESP in this type of situation and sensing can be allowed to proceed. For example, a comparison result value "1" can be calculated for the corresponding edge subpixel ESP.

The predetermined gray value can be, for example, 65 gray from among 0 to 255 gray values.

In this situation, when the gray value of an edge subpixel ESP corresponds to 0 to 64 gray values, the gray value of the corresponding edge subpixel ESP is less than 65 gray that is the predetermined gray value. The edge subpixel information calculator 1020 can calculate a value "0" as a comparison result value of the corresponding edge subpixel ESP and sensing can be delayed or prevented.

When the gray value of an edge subpixel ESP corresponds to 65 to 255 gray values, the gray value of the corresponding edge subpixel ESP is equal to or greater than 65 gray that is the predetermined gray value. The edge subpixel information calculator 1020 can calculate a value "1" as a comparison result value of the corresponding edge subpixel ESP and sensing can be allowed to proceed.

The real-time sensing determiner 1030 determines whether or not to perform the real-time sensing process by referring to the comparison result value calculated by the edge subpixel information calculator 1020.

When the comparison result values of all of the edge subpixels ESPs are low grays, respectively, the real-time sensing determiner 1030 can determine that the real-time sensing process is not to be performed during the blank period BLANK immediately before the image of the (N+1) th frame is displayed on the display panel 110.

For example, when the edge subpixel information calculator 1020 outputs the comparison result values of all of the edge subpixels ESPs in the image data of the (N+1)th frame as "0," the real-time sensing determiner 1030 can decide not perform the real-time sensing process during the blank period BLANK between an image display period ACT in which the image of the Nth frame is displayed and an image display period ACT in which the image of the (N+1)th frame is displayed.

When the comparison result value of one edge subpixel ESP among all of the edge subpixels ESPs in the image data of the (N+1)th frame is a high gray, the real-time sensing determiner 1030 can determine the real-time sensing process is to be performed during the blank period BLANK immediately before the image of the (N+1)th frame is displayed on the display panel 110.

Referring to FIG. 10A, before an image of a subsequent frame is displayed on the display panel 110, the real-time sensing subpixel selector 1040 can select one subpixel SP from among the plurality of subpixels SP as the real-time sensing subpixel RT Sensing SP.

Only when the real-time sensing determiner 1030 determines that the real-time sensing process is to be performed during the blank period BLANK immediately before the image of the (N+1)th frame is displayed on the display panel 110, the real-time sensing subpixel selector 1040 can select the real-time sensing subpixel RT Sensing SP.

When the real-time sensing determiner 1030 determines that the real-time sensing process is to be performed during the blank period BLANK immediately before an image of a subsequent frame is displayed, the real-time sensing subpixel selector 1040 selects the real-time sensing subpixel RT Sensing SP by referring to the values stored in the image data storage 1010 and the comparison result values calculated by the edge subpixel information calculator 1020.

The real-time sensing subpixel selector 1040 can select the edge subpixel ESP, the gray value of which is equal to or greater than the predetermined gray value, or one subpixel SP positioned on the same column as the edge subpixel ESP from among the plurality of subpixels SP as the real-time sensing subpixel RT Sensing SP by referring to the values stored in the image data storage 1010 and the comparison result values calculated by the edge subpixel information calculator 1020.

Here, the plurality of subpixels S positioned on the same column as the edge subpixel ESP refer to the subpixels SP to which the gate signal Vgate (e.g., a gate signal Vgate input to the edge subpixel ESP) is input.

The real-time sensing subpixel selector 1040 can select one subpixel SP positioned in the real-time sensing line RT Line including the edge subpixel ESP having a high gray value from among the plurality of subpixels SP as the real-time sensing subpixel RT Sensing SP to perform sensing on.

The real-time sensing subpixel selector 1040 can select the real-time sensing subpixel RT Sensing SP from the real-time sensing line RT Line randomly or based on predetermined criteria.

Consequently, the timing controller 140 can perform the real-time sensing process while preventing the real-time sensing line from being visually recognized by a user by using the position information of the subpixels SP and the gray value of the edge subpixel ESP. Thus, it is possible to reduce the phenomenon in which the real-time sensing line RT Line is visually recognized by a user while compensating for the characteristic values of the driving transistor in real time.

When the real-time sensing determiner 1030 decides to perform the real-time sensing process, the timing controller 140 can output a signal to control the driving circuit to sense changes in the characteristic values of the real-time sensing subpixel RT Sensing SP.

Here, the driving circuit collectively refers to a circuit for driving the display panel. For example, the driving circuit can include circuits for driving the display panel, such as the data driving circuit, the gate driving circuit, and a power management circuit.

In order to drive the driving circuit, the timing controller 140 can output a variety of control signals, such as a data driving circuit control signal and a gate driving circuit control signal, as described above.

Changes in the characteristic values of the real-time sensing subpixel RT Sensing SP can refer to changes in the mobility of the driving transistor DRT of the real-time sensing subpixel RT Sensing SP.

The timing controller 140 can control the driving circuit so that a recovery signal having a predetermined voltage level is applied to the plurality of subpixels SP positioned in the real-time sensing line RT Line in a period before an image of a subsequent frame is displayed on the display panel after the real-time sensing process is performed.

Referring to FIG. 10B, in the image data of the (N+1)th frame, the gray values of all of the edge subpixels ESPs can be low grays, each one being lower than the predetermined gray value.

The image data of the (N+1)th frame is stored in the image data storage 1010.

The edge subpixel information calculator 1020 compares the gray values of the edge subpixels ESP with the predetermined gray value by referring to the values stored in the image data storage 1010 and calculates the comparison result values.

Since the gray values of all of the edge subpixels ESPs are respectively smaller than the predetermined gray value, the edge subpixel information calculator 1020 calculates a comparison result value matching a low gray situation for all of the edge subpixels ESPs.

The real-time sensing determiner 1030 can select whether or not to perform the real-time sensing process during the blank period BLANK immediately before the image of the (N+1)th frame is displayed by referring to the comparison result value calculated by the edge subpixel information calculator 1020.

The real-time sensing determiner 1030 can stop or may not perform the real-time sensing process during the blank period BLANK, when the comparison result values correspond to a low gray situation for all of the edge subpixels ESPs by the edge subpixel information calculator 1020.

Thus, the real-time sensing subpixel selector 1040 does not select the real-time sensing subpixel RT Sensing SP, and the real-time sensing for this line of subpixels can be performed at a later time when image conditions are more favorable (e.g., when a high gray situation in present in the display data).

Consequently, when the gray values of all of the edge subpixels ESPs are low grays, any edge subpixel ESP, in which the real-time sensing line RT Line is not visually recognized, cannot be selected, and thus the real-time sensing process can be stopped or prevented. When new image data, the gray value of which is greater than the predetermined gray value, is input to the edge subpixel ESP, the real-time sensing process can be performed again.

Figure 11:
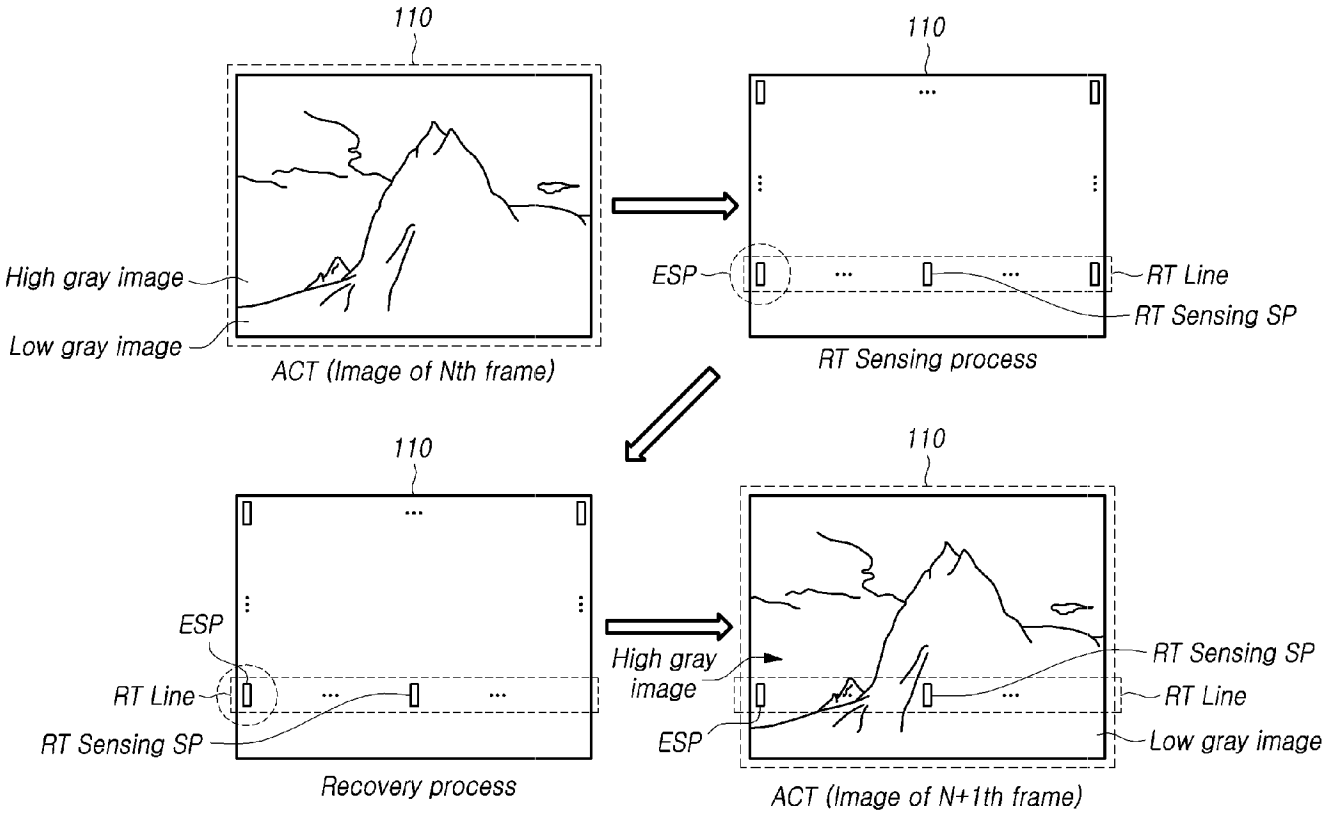
FIG. 11 illustrates selection of the real-time sensing subpixel in the image of the (N+1)th frame based on the gray value of the edge subpixel according to embodiments of the present disclosure.

FIG. 11 illustrates selection of the real-time sensing subpixel RT Sensing SP in the image of the (N+1)th frame based on the gray value of the edge subpixel ESP.

Referring to FIG. 11, during the image display period ACT, the display panel 110 displays the image of the Nth frame.

In the image of the (N+1)th frame, when there exists an edge subpixel ESP positioned in an area on which a high gray image portion is displayed, the real-time sensing process can be performed between a period in which the image of the Nth frame is displayed and a period in which the image of the (N+1)th frame is displayed.

While the real-time sensing process is being performed, the data signal for the real-time sensing is applied to the real-time sensing subpixel RT Sensing SP.

The real-time sensing subpixel RT Sensing SP is positioned in the same line as the edge subpixel ESP displaying a high gray image in the image of the (N+1)th frame.

After the real-time sensing process is performed, the recovery process can be performed. The recovery signal can be applied to the subpixels SP of the real-time sensing line RT Line.

Due to a low degree of delay of the gate signal, the edge subpixel ESP is driven brighter than other subpixels SP of the real-time sensing line RT Line that are located farther away.

However, since the edge subpixel ESP of the real-time sensing line RT Line in the image of the (N+1)th frame already displays a high gray image, the edge subpixel ESP of the real-time sensing line RT Line is not easily visually recognizable to a viewer (e.g., since this portion of the screen is already going to be relatively bright anyways, so sensing be safely carried out).

Consequently, even in the situation that the real-time sensing process is performed, the real-time sensing line RT Line is not easily visually recognized. Thus, the display quality can be improved.

Figure 12A:
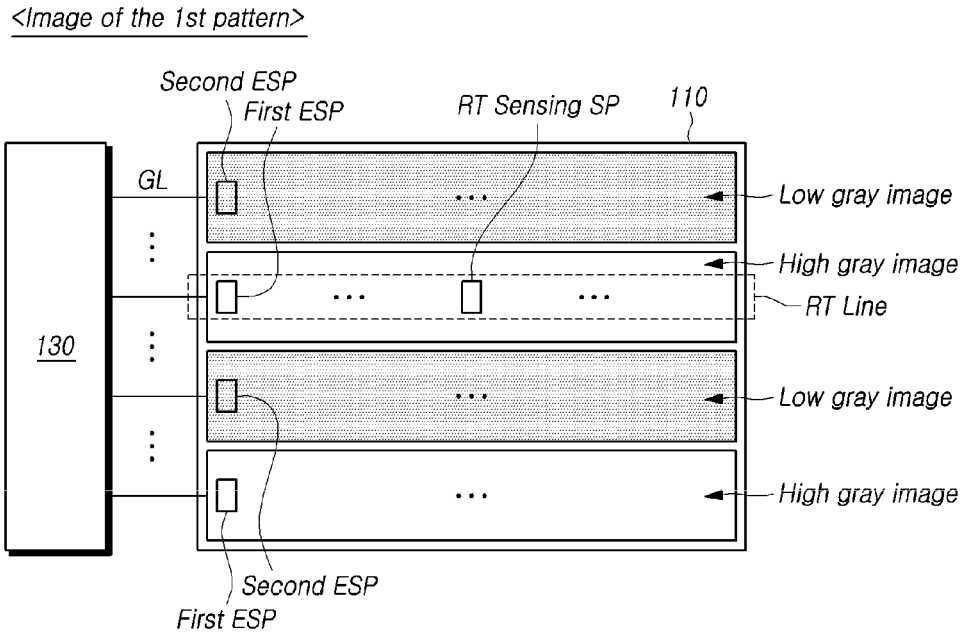
FIGS. 12A and 12B illustrate the position of a real-time sensing line when an image of a first pattern is displayed on the display panel during a plurality of frame periods according to embodiments of the present disclosure.
Figure 12B:
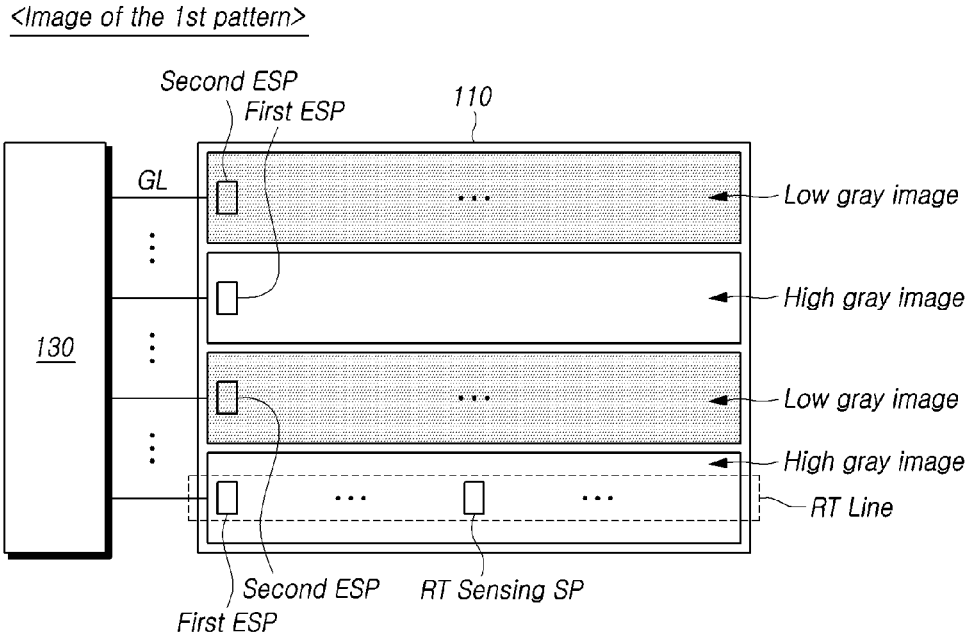

FIGS. 12A and 12B illustrate the position of a real-time sensing line when an image of a first pattern is displayed on the display panel 110 during a plurality of frame periods.

Referring to FIGS. 12A and 12B, the image of the first pattern is displayed on the display panel 110 during the plurality of frame periods.

The image of the first pattern is an image in which both a low gray image portion and a high gray image portion are displayed on a single screen.

In the image of the first pattern, some edge subpixels ESP among all of the edge subpixels ESPs display the low gray image, and the remaining edge subpixels ESP except for the some edge subpixels ESP display the high gray image.

While the image of the first pattern is being displayed on the display panel 110, all of an edge subpixel ESP and subpixels SP to which the same gate signal as input to the edge subpixel ESP is input can display the low gray image or the high gray image.

That is, while the image of the first pattern is being displayed on the display panel 110, all of the edge subpixel ESP and the subpixels SP sharing a gate line GL together with the edge subpixel ESP can display the low gray image or the high gray image.

The edge subpixel ESP displaying the high gray image while the image of the first pattern is being displayed on the display panel 110 during the plurality of frame periods will be referred to as a first edge subpixel First ESP.

In addition, the edge subpixel ESP displaying the low gray image while the image of the first pattern is being displayed on the display panel 110 during the plurality of frame periods will be referred to as a second edge subpixel Second ESP.

Referring to FIGS. 12A and 12B, during the plurality of frame periods in which the image of the first pattern is being displayed on the display panel 110, the real-time sensing line RT Line only includes the first edge subpixel First ESP but does not include the second edge subpixel Second ESP.

When the real-time sensing subpixel RT Sensing SP is selected from image data of a subsequent frame based on the gray values of the edge subpixels ESP according to embodiments, only the first edge subpixel First ESP can be included in the real-time sensing line RT Line. Thus, when the image of the first pattern is displayed during the plurality of frame periods, by determining that only the edge subpixel ESP corresponding to the first edge subpixel First ESP is included in the real-time sensing line RT Line, whether or not the "real-time sensing subpixel selecting process" according to embodiments is applied can be determined.

Accordingly, it is possible to determine whether or not the "real-time sensing subpixel selecting process" is applied by displaying the image of the first pattern on the display panel 110 during the plurality of frame periods.

Referring to FIGS. 12A and 12B, when two or more edge subpixels ESP displaying the high gray image in the image of the subsequent frame are present, the real-time sensing line RT Line can include an edge subpixel ESP having the highest gray value in the image of the subsequent frame. When two or more edge subpixels ESP displaying the high gray image in the image of the subsequent frame exist, the real-time sensing line RT Line can be selected to include, for example, the edge subpixel ESP having the highest gray value.

Figure 13:
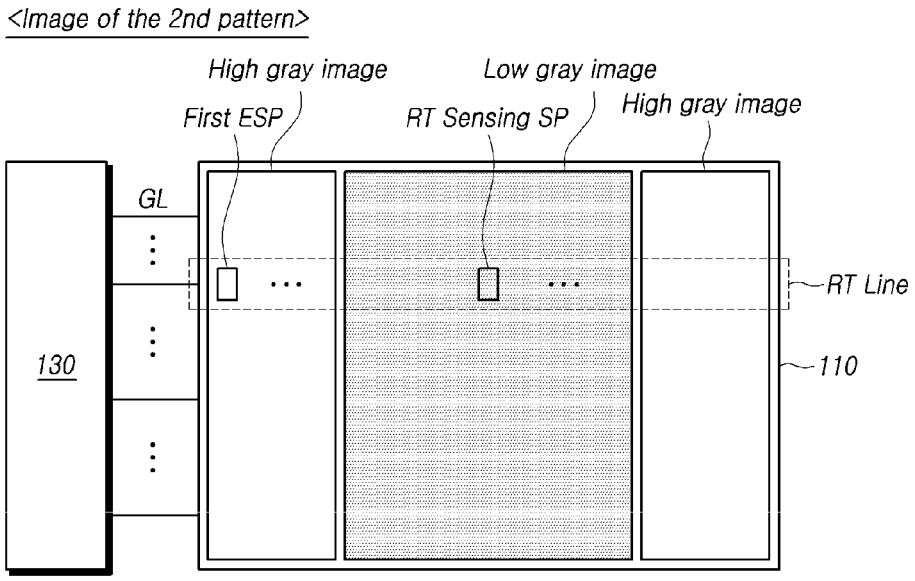
FIG. 13 illustrates the position of a real-time sensing line RT Line when an image of a second pattern is displayed on the display panel during a plurality of frame periods according to embodiments of the present disclosure.

FIG. 13 illustrates the position of a real-time sensing line RT Line when an image of a second pattern is displayed on the display panel 110 during a plurality of frame periods.

In the image of the second pattern, both a low gray image portion and a high gray image portion are displayed on a single screen.

In the image of the second pattern, all of the edge subpixels ESP of the display panel 110 display the high gray image.

That is, when the image of the second pattern is displayed on the display panel 110, all of the edge subpixels ESPs can correspond to the first edge subpixel First ESP.

While the image of the second pattern is being displayed during the plurality of frame periods, the real-time sensing subpixel RT Sensing SP can be randomly selected from among the plurality of subpixels SP.

Since all of the edge subpixels ESPs display the high gray image when the image of the second pattern is displayed on the display panel 110, even in the situation that the real-time sensing is performed, the phenomenon in which the real-time sensing line RT Line is visually recognized can be minimized. Thus, when the image of the second pattern is displayed during the plurality of frame periods, by determining that only the edge subpixel ESP corresponding to the first edge subpixel First ESP is included in the real-time sensing line RT Line, whether or not the "real-time sensing subpixel selecting process" according to embodiments is applied can be determined.

Consequently, whether or not the "real-time sensing subpixel selecting process" according to embodiments is applied can be determined by displaying the image of the second pattern on the display panel 110 during the plurality of frame periods.

Figure 14:
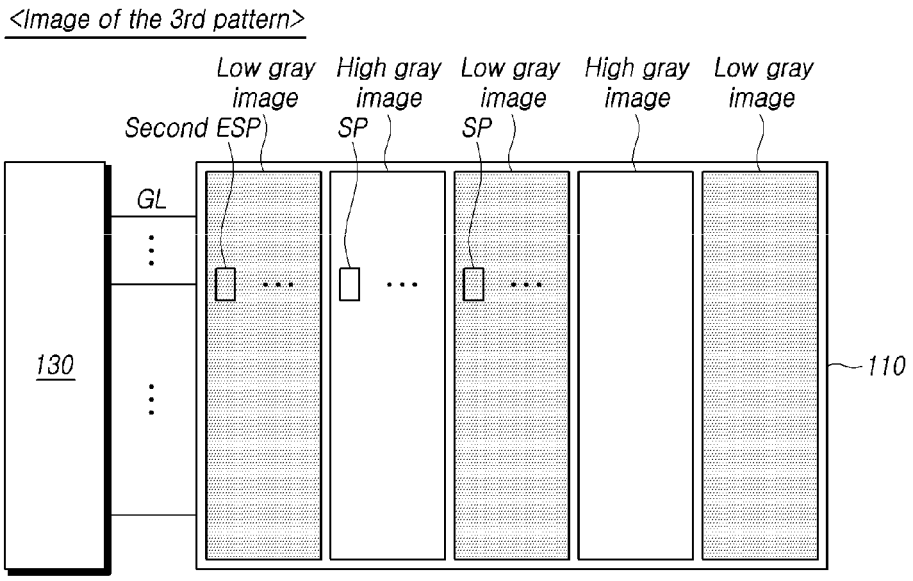
FIG. 14 illustrates a situation in which the real-time sensing is stopped when an image of a third pattern is being displayed on the display panel during a plurality of frame periods according to embodiments of the present disclosure.

FIG. 14 illustrates a situation in which the real-time sensing is stopped or completely prevented when an image of a third pattern is being displayed on the display panel 110 during a plurality of frame periods.

In the image of the third pattern, all of the edge subpixels ESP display a low gray image.

That is, while the image of the third pattern is being displayed on the display panel 110, all of the edge subpixels ESP can be considered as second edge subpixels Second ESP.

While the image of the third pattern is being displayed on the display panel 110 during the plurality of frame periods, the real-time sensing process may not be performed and can be carried out at a later time with lighting conditions of the image data are more favorable.

While the image of the third pattern is being displayed on the display panel 110 during the plurality of frame periods, when the real-time sensing process is performed, the real-time sensing line RT Line can be visually recognized, thus sensing can be prevented at this time.

For this reason, while the image of the third pattern is being displayed on the display panel 110, the real-time sensing process may not be performed.

Accordingly, it is determined that the real-time sensing is not performed by displaying the image of the third pattern on the display panel 110 during the plurality of frame periods, and thus whether or not the "real-time sensing subpixel selecting process" according to embodiments is applied can be determined.

As described above, by displaying each of the image of the first pattern, the image of the second pattern, and the image of the third pattern on the display panel 110 during the plurality of frame periods, whether or not the "real-time sensing subpixel selecting process" according to embodiments is used the display device can be determined.

The embodiments of the present disclosure set forth above will be briefly described as follows:

Embodiments can provide a display device 100 including: a display panel 110 including a plurality of subpixels SP displaying an image of a corresponding frame; a data driving circuit 120 configured to supply a data signal Vdata to the plurality of subpixels SP; a gate driving circuit 130 configured to supply a gate signal Vgate to the plurality of subpixels SP; and a timing controller 140 configured to receive image data of a subsequent frame of an image being displayed on the display panel 110 and differently control the data driving circuit 120 during a blank period BLANK between a period in which the image of the corresponding frame is displayed and a period in which an image of the subsequent frame is displayed, depending on gray values of a plurality of edge subpixels ESP adjacent to the gate driving circuit 130 in the image data of the subsequent frame.

In the display device 100 according to embodiments, each of the plurality of subpixels SP can include a driving transistor DRT and an emitting element ED. The display panel 110 can further include a plurality of reference voltage lines RVL each electrically connected to a sensing node at which the driving transistor DRT is electrically connected to the emitting element ED. The data driving circuit 120 can include an analog-to-digital converter ADC sensing a voltage on the sensing node. When the gray value of each of the plurality of edge subpixels ESP in the image data of the subsequent frame input to the timing controller 140 is smaller than a predetermined gray value, the data driving circuit 120 does not sense a reference voltage line RVL among the plurality of reference voltage lines RVL during the blank period BLANK between the period in which the image of the corresponding frame is displayed and the period in which the image of the subsequent frame is displayed. When the gray value of one edge subpixel ESP among the plurality of edge subpixels ESP in the image data of the subsequent frame input to the timing controller 140 is equal to or greater than the predetermined gray value, the data driving circuit 120 senses the reference voltage line RVL electrically connected to the one edge subpixel ESP or a subpixel SP, among the plurality of subpixels SP, to which a gate signal Vgate the same as a gate signal input to the one edge subpixel ESP is input, during the blank period BLANK between the period in which the image of the corresponding frame is displayed and the period in which the image of the subsequent frame is displayed.

In the display device 100 according to embodiments, when the gray value of the one edge subpixel ESP among the plurality of edge subpixels ESP in the image data of the subsequent frame input to the timing controller 140 is equal to or greater than the predetermined gray value, the timing controller 140 can select a real-time sensing line RT Line including the one edge subpixel ESP and subpixels SP, among the plurality of subpixels SP, to which the gate signal Vgate the same as the gate signal input to the one edge subpixel ESP is input, and select one subpixel SP from among the plurality of subpixels SP included in the real-time sensing line RT Line as a real-time sensing subpixel RT Sensing SP.

In the display device 100 according to embodiments, in a period in which a real-time sensing process is performed between the period in which the image of the corresponding frame is displayed and the period in which the image of the subsequent frame is displayed, the data driving circuit 120 can supply the data signal Vdata to the real-time sensing subpixel RT Sensing SP and sense the reference voltage line RVL electrically connected to the real-time sensing subpixel RT Sensing SP.

In the display device 100 according to embodiments, in a period in which a recovery process is performed after the real-time sensing process is performed, the data driving circuit 120 can supply a recovery signal Recovery Data to the plurality of subpixels SP included in the real-time sensing line RT Line.

In the display device 100 according to embodiments, the recovery signal Recovery Data may have a voltage level lower than a voltage level of a mobility sensing data signal input to the real-time sensing subpixel RT Sensing SP while the real-time sensing process is being performed.

In the display device 100 according to embodiments, the amount of current flowing through the emitting element ED of the edge subpixel ESP included in the real-time sensing line RT Line due to the recovery process can be greater than the amount of current flowing through the emitting element ED of each of the remaining subpixels SP included in the real-time sensing line RT Line due to the recovery process.

Embodiments can provide a timing controller 140 configured to control a driving circuit 120 and 130 to drive a display panel 110 by receiving image data of a subsequent frame of an image being displayed on the display panel 110. The timing controller 140 can include: an image data storage 1010 configured to store, from the image data, values matching positions of a plurality of subpixels SP and gray values according to the positions of the plurality of subpixels SP; an edge subpixel information calculator 1020 configured to, by referring to the values stored in the image data storage 1010, compare gray values of edge subpixels ESP positioned in an edge area of the display panel 110 with a predetermined gray value and calculate comparison result values according to results of the comparison; and a real-time sensing determiner 1030 configured to determine whether or not to perform a real-time sensing process by referring to the comparison result values calculated by the edge subpixel information calculator 1020.

The timing controller 140 according to embodiments can further include a real-time sensing subpixel selector 1040 configured to select one subpixel SP from among the plurality of subpixels SP as a real-time sensing subpixel RT Sensing SP before an image of the subsequent frame is displayed on the display panel 110.

In the timing controller 140 according to embodiments, when the real-time sensing determiner 1030 determines the real-time sensing process to be performed during a blank period BLANK immediately before the image of the subsequent frame is displayed, the real-time sensing subpixel selector 1040 can select the real-time sensing subpixel RT Sensing SP by referring to the values stored in the image data storage 1010 and the comparison result values calculated by the edge subpixel information calculator 1020.

In the timing controller 140 according to embodiments, the real-time sensing subpixel selector 1040 can select one edge subpixel ESP having a gray value equal to or greater than the predetermined gray value from among the edge subpixels ESP or one subpixel SP positioned in the same row as the one edge subpixel ESP from among the plurality of subpixels SP as the real-time sensing subpixel RT Sensing SP.

In the timing controller 140 according to embodiments, when the real-time sensing determiner 1030 determines to perform the real-time sensing process, the timing controller 140 can output a signal for controlling the driving circuit 120 and 130 in order to control a change in characteristic values of the real-time sensing subpixel RT Sensing SP during the blank period BLANK immediately before the image of the subsequent frame is displayed on the display panel 110.

In the timing controller 140 according to embodiments, in a period before the image of the subsequent frame is displayed on the display panel 110 after the real-time sensing process is performed, the timing controller 140 can control the driving circuit 120 and 130 so that a recovery signal Recovery Data having a predetermined voltage level is applied to subpixels SP, among the plurality of subpixels SP, positioned in the same row as the real-time sensing subpixel RT Sensing SP.

Embodiments can provide a display device 100 including: a display panel 110 including a plurality of subpixels SP; a data driving circuit 120 supplying a data signal Vdata to the plurality of subpixels SP; and a timing controller 140 controlling the data driving circuit 120 by receiving image data having two gray values during a plurality of frame periods. The plurality of subpixels SP can include edge subpixels ESP positioned adjacent to the gate driving circuit 130. The edge subpixels ESP can include first edge subpixels First ESP displaying a high gray image of the two gray values during the plurality of frame periods. The data driving circuit 120 can apply the data signal Vdata having a first voltage level to one edge subpixel ESP among the first edge subpixels First ESP or one subpixel SP, among the plurality of subpixels SP, to which a gate signal Vgate the same as a gate signal Vgate input to the one edge subpixel ESP is input, in a blank period BLANK. After a period in which the data signal Vdata having the first voltage level is applied to the subpixel SP, the data driving circuit 120 can apply the data signal Vdata having a second voltage level lower than the first voltage level to subpixels SP, from among the plurality of subpixels SP, positioned in the same row as the subpixel SP to which the data signal Vdata having the first voltage level is applied.

In the display device 100 according to embodiments, the data signal Vdata having the first voltage level can be a mobility sensing data signal for sensing the mobility of the driving transistor DRT, and the data signal Vdata having the second voltage level can be a recovery signal Recovery Data.

The above description has been presented to enable any person skilled in the art to make and use the technical idea of the present invention, and has been provided in the context of a particular application and its requirements. Various modifications, additions and substitutions to the described embodiments will be readily apparent to those skilled in the art, and the general principles defined herein can be applied to other embodiments and applications without departing from the spirit and scope of the present invention. The above description and the accompanying drawings provide an example of the technical idea of the present invention for illustrative purposes only. That is, the disclosed embodiments are intended to illustrate the scope of the technical idea of the present invention. Thus, the scope of the present invention is not limited to the embodiments shown, but is to be accorded the widest scope consistent with the claims. The scope of protection of the present invention should be construed based on the following claims, and all technical ideas within the scope of equivalents thereof should be construed as being included within the scope of the present invention.

What is claimed is:

1. A display device comprising:

a display panel including a plurality of subpixels configured to display an image of a corresponding frame;

a data driving circuit configured to supply a data signal to the plurality of subpixels;

a gate driving circuit configured to supply a gate signal to the plurality of subpixels; and a timing controller configured to:

receive image data of a subsequent frame of an image of a current frame being displayed on the display panel, and differently control the data driving circuit during a blank period between the current frame and the subsequent frame based on a gray value of at least one edge subpixel among a plurality of edge subpixels in the image data of the subsequent frame, wherein the plurality of edge subpixels are subpixels among the plurality of subpixels that are located adjacent to the gate driving circuit or at an edge of the display panel.

2. The display device of claim 1, wherein each of the plurality of subpixels includes a driving transistor and an emitting element, wherein the display panel further includes a plurality of reference voltage lines each electrically connected to a sensing node of a corresponding subpixel among the plurality of subpixels, wherein the data driving circuit includes an analog-to-digital converter configured to sense a voltage of the sensing node, wherein the timing controller is further configured to:

prevent the data driving circuit from sensing the plurality of reference voltage lines during the blank period when one or more gray values of the plurality of edge subpixels in the image data of the subsequent frame are less than a predetermined gray value, and control the data driving circuit to sense a reference voltage line corresponding to at least one edge subpixel of the plurality of reference voltage lines during the blank period when the gray value of the at least one edge subpixel in the image data of the subsequent frame is equal to or greater than the predetermined gray value.

3. The display device of claim 2, wherein the timing controller is further configured to:

select a real-time sensing line including the at least one edge subpixel when the gray value of the at least one edge subpixel in the image data of the subsequent frame is equal to or greater than the predetermined gray value, and select one subpixel from among subpixels included in the real-time sensing line as a real-time sensing subpixel to be sensed during the blank period.

4. The display device of claim 3, wherein the data driving circuit is further configured to:

supply the data signal to the real-time sensing subpixel and sense the corresponding reference voltage line electrically connected to the real-time sensing subpixel, in a period in which a real-time sensing process is performed between the current frame and the subsequent frame.

5. The display device of claim 4, wherein the data driving circuit is further configured to:

supply a recovery signal to the subpixels included in the real-time sensing line in a period in which a recovery process is performed after the real-time sensing process is performed.

6. The display device of claim 5, wherein the recovery signal has a voltage level lower than a voltage level of a mobility sensing data signal input to the real-time sensing subpixel during the real-time sensing process.

7. The display device of claim 5, wherein an amount of current flowing through an emitting element of the at least one edge subpixel included in the real-time sensing line due to the recovery process is greater than an amount of current flowing through emitting elements in remaining subpixels included in the real-time sensing line due to the recovery process.

8. The display device of claim 3, wherein the one subpixel to be sensed during the blank period is randomly selected from among subpixels electrically connected to a same gate line as the at least one edge subpixel having the gray value that is equal to or greater than the predetermined gray value.

9. The display device of claim 3, wherein the one subpixel to be sensed during the blank period has a highest gray value among subpixels electrically connected to a same gate line as the at least one edge subpixel during the subsequent frame.

10. The display device of claim 1, wherein the timing controller is further configured to:

select a subpixel from among the plurality of subpixels as a real-time sensing subpixel to be sensed during a blank period before an image of the subsequent frame is displayed on the display panel, wherein the subpixel is only selected from image portions of the subsequent frame that have a gray value that is greater than or equal to a predetermined gray value.

11. A timing controller for controlling a display panel, the timing controller comprising:

an image data storage configured to store values from image data of a subsequent frame of an image of a current frame being displayed on the display panel, the values matching positions of a plurality of subpixels in the display panel and gray values according to the positions of the plurality of subpixels;

an edge subpixel information calculator configured to compare gray values of edge subpixels positioned in an edge area of the display panel with a predetermined gray value based on the values stored in the image data storage and calculate comparison result values according to results of the comparison; and a real-time sensing determiner configured to determine whether or not to perform a real-time sensing process based on the comparison result values calculated by the edge subpixel information calculator.

12. The timing controller of claim 11, further comprising:

a real-time sensing subpixel selector configured to select one subpixel from among the plurality of subpixels as a real-time sensing subpixel to be sensed during a blank period before an image of the subsequent frame is displayed on the display panel.

13. The timing controller of claim 12, wherein, the real-time sensing subpixel selector selects the real-time sensing subpixel based on the values stored in the image data storage and the comparison result values calculated by the edge subpixel information calculator when the real-time determiner determines that the real-time sensing process is to be performed during the blank period between the current frame and the subsequent frame.

14. The timing controller of claim 13, wherein the real-time sensing subpixel selector is configured to select one edge subpixel having a gray value equal to or greater than the predetermined gray value from among the edge subpixels or one subpixel positioned in a same row as the one edge subpixel from among the plurality of subpixels as the real-time sensing subpixel to be sensed during the blank period.

15. The timing controller of claim 14, wherein the timing controller is further configured to output a signal for controlling the driving circuit in order to control a change in characteristic values of the real-time sensing subpixel during the blank period immediately before the image of the subsequent frame is displayed on the display panel when the real-time determiner determines that the real-time sensing process is to be performed during the blank period.

16. The timing controller of claim 15, wherein the timing controller is further configured to control the driving circuit to supply a recovery signal having a predetermined voltage level to subpixels, among the plurality of subpixels, positioned in the same row as the real-time sensing subpixel.

17. The timing controller of claim 13, wherein the one subpixel to be sensed during the blank period is randomly selected from among subpixels electrically connected to a same gate line as at least one edge subpixel having the gray value that is equal to or greater than the predetermined gray value.

18. The timing controller of claim 13, wherein the one subpixel to be sensed during the blank period has a highest gray value among subpixels electrically connected to a same gate line as the at least one edge subpixel having the gray value that is equal to or greater than the predetermined gray value during the subsequent frame.

19. The timing controller of claim 11, wherein the timing controller is further configured to:

select a subpixel from among the plurality of subpixels as a real-time sensing subpixel to be sensed during a blank period before an image of the subsequent frame is displayed on the display panel, wherein the subpixel is only selected from image portions of the subsequent frame that have a gray value that is greater than or equal to a predetermined gray value.

* * * * *